United States Patent [19]

Fukuda et al.

[11] Patent Number: 4,760,995

[45] Date of Patent: Aug. 2, 1988

[54] CONTINUOUSLY TREATING LINE FOR STEEL BANDS HAVING A HEATING FURNACE BY DIRECTLY FLAMING

[75] Inventors: Shuzo Fukuda; Masahiro Abe; Shiro Fukunaka, all of Yokohama; Michio Nakayama, Kawasaki; Shuji Kaneto; Masayuki Yamazaki, both of Fukuyama; Kouichiro Arima, Tama, all of Japan

[73] Assignee: Nippon Kokan Kabushiki Kaisha, Tokyo, Japan

[21] Appl. No.: 27,224

[22] PCT Filed: Jul. 10, 1986

[86] PCT No.: PCT/JP86/00352

§ 371 Date: Mar. 2, 1987

§ 102(e) Date: Mar. 2, 1987

[87] PCT Pub. No.: WO87/00555

PCT Pub. Date: Jan. 29, 1987

[30] Foreign Application Priority Data

| | | | |
|---|---|---|---|
| Jul. 18, 1985 | [JP] | Japan | 60-156898 |
| Aug. 31, 1985 | [JP] | Japan | 60-192601 |
| Aug. 31, 1985 | [JP] | Japan | 60-192603 |
| Aug. 31, 1985 | [JP] | Japan | 60-192604 |
| Aug. 31, 1985 | [JP] | Japan | 60-192605 |
| Aug. 31, 1985 | [JP] | Japan | 60-192608 |
| Aug. 31, 1985 | [JP] | Japan | 60-192611 |
| Aug. 31, 1985 | [JP] | Japan | 60-192612 |
| Aug. 31, 1985 | [JP] | Japan | 60-192613 |

[51] Int. Cl.[4] ..... C21D 9/56

[52] U.S. Cl. ..... 266/103; 266/107; 266/109; 266/110; 266/111; 72/201

[58] Field of Search ..... 266/102, 103, 107, 109, 266/110–113, 115, 78, 89, 90, 135; 72/201; 134/122 R, 64 R

[56] References Cited

U.S. PATENT DOCUMENTS 4,239,483 12/1980 Lida et al. ..... 432/8

FOREIGN PATENT DOCUMENTS

| | | | |
|---|---|---|---|
| 27606 | 7/1977 | Japan | 266/103 |
| 21830 | 5/1981 | Japan | 148/156 |
| 77929 | 5/1985 | Japan | 148/156 |
| 77931 | 5/1985 | Japan | 148/156 |

*Primary Examiner*—Christopher W. Brody
*Attorney, Agent, or Firm*—Moonray Kojima

[57] ABSTRACT

This invention relates to a continuously treating line for a steel band, having a heating furnace by directly flaming. For heating the steel band with causing reduction, the heating furnace of directly flaming system is provided with a plurality of heating burners of reduction system which may form non-equilibrium range of the air and the fuel in a flame, that is, a reduction range, wherein the heating burners are positioned at predetermined arrangement with respect to the steel band and at a certain pitch predetermined in relation with an inner diameter of the burner in a line running direction.

The treating line has said heating furnace constructed as mentioned above and a subsequent atmosphere furnace, and said atmosphere furnace may be provided with a sealing chamber having various means for avoiding invasion of the outer air.

The line has, in order, a pre-heating furnace, said heating furnace and an indirectly heating furnace, and it may be furnished with intermediate chambers between respective furnaces for preventing the furnace gas from moving, and further may be furnished with an after-burning chamber for perfectly burning a combustion exhaust gas to be supplied to the pre-heating chamber.

52 Claims, 16 Drawing Sheets

I : Pre-heating furnace
II : Direct flame heating furnace
III : RT-heating · soaking furnace I : Pre-heating furnace
II : Direct flame heating furnace
III : RT-heating · soaking furnace I: Oxidation by preheatig
II: Oxidized film on base plate : 20Å
III: Heating by slight oxidation (#1~#4)
IV: Heating with reduction (#5~#6)

I : Oxidation by preheating
II : Oxidized film on base plate : 20Å

I: Pre-heating furnace
II: Direct flame heating furnace
III: Indirect heating furnace

CONTINUOUSLY TREATING LINE FOR STEEL BANDS HAVING A HEATING FURNACE BY DIRECTLY FLAMING

TECHNICAL FIELD

This invention relates to a continuously treating line for steel bands having a heating furnace by directly flaming where the heating is available without causing oxidation or with reduction.

BACKGROUND OF THE INVENTION

Known heating manners in a continuously treating line for a steel band are a direct flame heating system and an indirectly heating system using radiant tubes. The former is more excellent in heating efficiency in comparison with the latter, and since it may burn out a cold rolling oil, a cleaning facility may be saved, it has been used widely in a hot-dip zinc plating line, a continuously annealing line for electromagnetic steel plates, and others.

However, in the conventional direct flame heating system, oxidation of the steel band is remarkable, and there arises a big problem causing roll peakup thereby. For such conventional ones, so-called direct flame heating system without causing oxidation has been proposed for continuously heat treating facilities in Japanese Patent Publication No. 44,133/83 and Japanese Patent Publication No. 29,651/84. These systems lower air ratios (less than 1.4→0.6) in combustion control zones in response to heightening of strip temperatures (Max. 900°), and carry out the heating while controlling oxidation of the steel band.

These systems are called as non-oxidation, but actually they are slight oxidation systems. Since oxidizing gases such as $C_2$ or $H_2O$ are much contained in gases generated in combustion, thickness of oxidized film after heating comes up to from less than 50 Å to 500–1000 Å. Therefore, when such a system is applied to the continuously annealing facility, it is inevitable that hydrogen in the atmosphere is made high in concentration about 20%) in a soaking zone following a heating zone, so as to reduce the oxidized film, otherwith the direct flame heating furnace is, at its exit, furnished with a treating zone serving as a forcibly reducing zone, so as to reduce the oxidized film with hydrogen of high concentration (more than about 50%).

Continuously annealing facilities recently developed have become large scaled aiming at decreasing production costs. In these facilities if the above mentioned direct flame heating zone were built in 1 PASS (a steel band runs once within the heating zone), a furnace would be very tall, and problems would arise that the steel band flutters as running or controlling of the furnace is difficult. Therefore, the heating zone could not be but built in 2 PASS or more. However, in such direct flame heating zone of plural PASSes, the roll within the heating zone is caused with roll pickup due to the oxidized film and the surface appearance of the steel band is remarkably spoiled. For avoiding the roll pickup, complicated instruments should be required, for example, an isolation chamber filled with a protecting atmosphere for housing the roll within the furnace, as disclosed in Japanese Patent Application Laid Open No. 53-54100 (1978). Also in the roll protecting system, it is very difficult to exactly provide a sealing between the roll isolation chamber and the heating furnace at high temperature. The protecting atmospheric gas must be much supplied to fully charge the protecting atmosphere in the isolation chamber. As a heating treatment in the continuously hot-dip zinc plating line, so-called Senzimir system is known. In the continuously annealing cycle, this system heats the steel by directly flaming it up to about 400° to 450° C. and subsequently indirectly heats it up to about 750° C. in a forcibly reducing atmosphere. But this system has difficulties as under.

(1) indirect heating time is long, and heating efficiency is bad, (2) forcibly reducing atmosphere, i.e. ($H_2+N_2$) having high $H_2$ concentration required, and a problem arises about safety, and (3) when the soaking is performed, the length of the furnace is made large.

In view of Senzimir system, another system has been developed and now used widely which carries out a slight oxidation heating in so-called NOF furnace and subsequently does reduction by indirect heating in a following weak reduction furnace. But this system also has difficulties as under.

(1) indirect heating time is long, (2) in the weak oxidation-weak reduction process, a surface activity of the steel band is not fully obtained which is required to plating adhesion, and (3) the length of the furnace is made large.

In addition, the conventional continuously annealing line has further problems as follows.

1st problem: In the continuously heat treating furnace installed with the direct flame heating furnace, the steel band is heated up to 500° to 800° C. without causing oxidation or with reduction, and subjected to the treatments of heating, soaking and rapid cooling, and it is cooled down less than about 150° where oxidation in the atmosphere is no problem, and left in the air. The furnace is maintained therein in positive pressure of about +5 to 15 mmWC so as to prevent the invasion of the atmosphere and is charged with the atmospheric gas (3 to 20% $H_2$ and the rest being $N_2$) for reduction and prevention of oxidation.

For a sealing mechanism which leads out the heat-treated steel band in the air, a seal roll system and a water envelop system are taken into consideration. But these systems have difficulties as under.

(1) Seal roll system

This system is disposed with a pair of seal rolls at an exit of the steel band, but spaces are inevitably formed between upper and lower rolls at the both sides of the steel band and between the furnace wall and the rolls. Therefore, a perfect seal could not be promised.

Ordinarily, a bit of atmospheric gas is blown out from said spaces to prevent the invasion of the air. However, if a negative pressure were caused in the furnace due to changes in combustion within the heating furnace, the air would enter thereinto.

(2) Water envelop system

This system seals the exit of the atmospheric furnace by means of a water enveloping tank, and passes the steel band therethrough. But steam will go into the furnace as the air invasion.

2nd problem: In the continuously treating line installed with the indirectly heating furnace following the direct flame heating furnace, the atmospheric gas of the indirectly heating furnace flows into the direct flame heating furnace, and further a mixture of the combustion exhaust gas of said heating furnace and the atmospheric gas flows into the preheating furnace, and finally goes outside. In this case, the pressure within the furnace is extremely fluctuated by the mutual interferences in the respective zones due to changings in flows therein and this phenominon could not be dealt with. Further, if the combustion exhaust gas containing non-burnt contents is introduced into the preheating furnace, the temperature of the exhaust gas becomes low at the exit thereof, and perfect combustion of the non-burnt content is difficult.

The present inventioin is to remove the above mentioned defects involved with the conventional continuously treating line, and provide this kind of an improved continuously treating line.

It is an object of the invention to provide a continuously treating line which may heat the steel band without causing oxidation or with causing reduction in a direct flame heating furnace installed therein.

It is another object of the invention to provide a continuously treating line which may carry out the heating and the soaking on the steel band at high temperatures without causing oxidation or with causing reduction.

It is another object of the invention to provide a continuously treating line which may normally perform the heating on the steel band without causing oxidation and with causing reduction.

It is another object of the invention to provide a continuously treating line which makes a non-oxidizing condition at least when the steel band gets out of the direct flame heating furnace.

It is another object of the invention to provide a continuously treating line which makes a non-oxidizing condition at least when the steel band contacts the roll within the furnace so that the roll pickup may be prevented.

It is another object of the invention to provide a continuously treating line which shortens the indirectly heating time and the length of a whole furnace and by which a surfce activity of the steel band required to plating adhesion may be sufficient.

It is another object of the invention to provide a continuously treating line having the direct flame heating furnace and a subsequent atmosphere furnace, wherein the air is exactly prevented from invasion thereinto.

It is another object of the invention to provide a continuously treating line having in order a preheating furnace, the direct flame heating furnace and the indirectly heating furnace, wherein the gas is checked to move to another furnace, so that the mutual interference due to fluctuation of the furnace gas is prevented.

It is another object of the invention to provide a continuously treating line having in order the preheating furnace, the direct flame heating furnace and the indirectly heating furnace, wherein the combustion exhaust gas is utilized for efficiently performing the preheating of the steel band.

DISCLOSURE OF THE INVENTION

The direct flame heating furnace installed in the continuously treating line has a plurality of the heating burners of reduction type. This burner may form a range having products in the intermediate combustion and not having free oxygen in the flame, that is, non-equilibrium range of the air and the fuel. In the invention, the heating burners of reduction type are so arranged that the flame collides against the steel band on its surface almost perpendicularly within said non-equilibium range, and said plural burners are positioned with spaces where (inner diameter of burner)/(pitch of burner) is more than 0.3.

The present invention is applicable to the continuously treating line of every embodiment having the direct flame heating furnace.

In the direct flame heating furnace having the heating burner of the reduction type, temperatures are about 900° C. where the steel band can be heated without causing oxidation and with causing reduction. If the steel band is heated at higher tempertures, an indirectly heating furnace is installed following the direct flame heating furnace.

If the treating line is a continuously annealing line, there are embodiments as mentioned under:

(1) a line, which is provided, in order, with the direct flame heating furnace, the indirect heating furnace and a cooling furnace where cooling is main for rolls, and is provided with a temper rolling machine at an exit of a finally treated steel finally treated steel band;

(2) a line, which is provided with a preheating furnace at an upper side of the direct flame heating furnace of the above line;

(3) a line which is provided with a cleaning facility at an upper side of the preheating furnace of the above line (2);

(4) a line, which is provided, in order, with the direct flame heating furnace, the indirect heating furnace and a cooling where finally treated steel band;

(5) a line, which is provided with a preheating furnace at an upper side of the direct flame heating furnace of the above line (4); and (6) a line which is provided with a cleaning facility at an upper side of the preheating furnace of the above line (5). Passing through these lines, the steel band may be continuously annealed efficiently without problems arising about oxidation.

If the treating line is a continuously hot-dip zinc plating line, there are a line which has, in order, the direct flaming oxidizing furnace—the direct flame reducing furnace (direct flame heating furnace having a heating burner of reduction type)—a soaking furnace of indirectly heating system—a hot-dip zinc plating device, or a line which has the direct flame reducing furnace and a subsequent hot-dip zinc plating device, having not said soaking furnace.

If the treating line has the direct flame heating furnace and a following atmosphere furnace, it may be provided with a sealing chamber at an upper side of an exit sealing roll of the atmosphere furnace and further it may be provided with measures for detecting the pressure of the atmosphere furnace and measures for blowing the sealing gas into the sealing chamber when the pressure is lowered, thereby to prevent the invasion of the air into the atmosphere.

If the treating line has in order the preheating furnace, the direct flame heating furnace and the indirectly heating furnace, it may be provided with intermediate chambers between said furnaces, and further it may be, if required, provided with an after-burning chamber between the direct flame heating furnace and the preheating furnace, said after burning chamber effecting perfect combustion on the combustion exhaust gas within the direct flame furnace for supplying it to the preheating furnace, thereby to prevent the furnace gas from moving into the other furnace, and check the mutual interference between the furnaces due to the fluctuation of the gas pressure within the furnace, and further utilize the combustion exhaust gas for carrying out the preheating of the steel band efficiently.

In the continuously treating lines of the above mentioned various embodiments, the heating burners of reductioin type may be provided all over the heating available range of the direct flame heating furnace. However, said burner has a smaller capacity than generally used burner of non-reducing type (diffusion type). If these burners are installed over the full available length of the furnace, a lot of burners should be closely disposed, otherwise required heat capacity is not kept.

It is reasonable to dispose said burners only at necessary and enough ranges, and following structures may be adopted A 1st adaptable embodiment is that the reducing burners are placed such that the steel band is under the non-oxidizing condition when the steel band gets out of at least the direct flame heating furnace. Its content is as follows:

In an available length of the furnace, the burner of reducing type is disposed at said pitch (inner diameter of burner/pitch of burner ≧0.3) in the length of the furnace exit of more than $\gamma$% which is obtained by an under mentioned equation, while the burner of non-reducing type is disposed in a remainining available length of the burner.

$$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 $[=69200\ e^{-(6126/T)}]$ F(T): Heating rate (°K/sec) [=dT/dt]

A 2nd adaptable embodiment is that the reducing burners are placed such that the steel band is under the non-oxidizing condition at least when it contacts the roll in the furnace, thereby to avoid the roll pickup and send the steel band under the non-oxidizing condition from the direct flame heating furnace. Its content is that the reducing burners are disposed at the region of the PASS-exit including the heating region just before at least the passing rolls at the exit of the direct flame heating furnace.

In the invention, the reducing burners are employed in a a determined condition which may form non-equilibrium range of the air and the fuel in the flame where the products in the intermediate combustion stay and free oxygen does not stay. A regin which has finished combustion reaction and contains $CO_2$, $H_2O$, $N_2$, $H_2$, CO and others, that is, a semi-equilibrium range is oxidizing, and on the other hand said non-equilibrium range containing intermediate ion, radical and others shows reduction, and such a burner renders the flame to collide against the steel band almost perpendicularly in the non-equilibrium range, so that the steel band can be heated without oxidation.

FIGS. 3 and 4 show one example of said heating burner of reduction type, where a plurality of combustion air jetting outlets 2 are formed with spaces in an inner wall 6 of a cylindrical burner tile 1 in circumferential direction thereof, and a plurality of fuel gas jetting outlets 3 are formed centrally of the burner, and in addition the combustion air outlet 2 and the fuel gas outlet 3 are composed as under:

(a) the combustion air outlet 2 is formed such that an air jetting direction has an angle $\theta 1$ of not more than 60° with respect to a tangent of an inner circumference of the burner tile;

(b) a distance N in an axial direction of the burner between the combustion air outlet 2 and the fuel gas outlet 3 is determined from −0.1 to +0.4 D (D: inner diameter of burner), when a case that the fuel gas outlet is positioned at the side of the exit of the burner tile than the combustion air outlet 2, is (−) and a contrary case thereof is (+); and (c) a distance L from the combustion air outlet 2 to the exit of the burner tile is determined from 0.6 to 3 D (D: same).

The thus composed burner forms non-equilibrium range of the air and the fuel in a determined scope in the flame by controlling the air ratio not more than 1.0. That is, the heating burner may rapidly provide combustion by swirling flow of the air from the air outlet 2 and the fuel gas from the center of the burner, and form a range not containing non-reacting free oxygen, i.e., non-equilibrium range of the air and the fuel stably and widely, since the flame much contains products in the intermediate combustion over a determined scope outside of the burner exit.

FIG. 1 shows one example of the non-equilibrium range of the air and the fuel in the flame to be formed by the burner, measured with an ion detecting probe, where a high value of electric current implies that an ion strength is large and said range much contains products in the intermediate combustion. According to this fact, the non-equilibrium range is formed over the determined range outside of the burner exit, and in an outside of this outlet a semi-equilibrium range is formed containing $CO_2$, $H_2O$, $N_2$ and others.

FIG. 6 shows reduction heating characteristics of the burner, that is, limit temperatures where a steel band may be heated without causing oxidation (limit temperature for thin plate or ordinary steel). The steel band may be heated up to about 900° C. in a range between 0.85 and 0.95 of the air ratio without causing oxidation.

The present invention may use so-called radiant cup burner as the reducing burner other than the heating burner. The radiant cup burner rapidly burns a mixture of the air and the fuel gas having been mixed in advance in a hemi-spherical cup of the burner tile for providing rapid combustion reaction so as to increase temperature of the inner surface of the burner tile, and heats the strip by the radiant heat conduction from said inner surfce. This burner has a characteristic to bring about the flow flux of high temperatures in a range of the high temperautre of the heat material. If the fuel gas is burnt at the air ratio of not more than 1.0, it is possible to form the non-equilibrium range.

This radiant burner depends upon a pre-mixture of the combustion air and the fuel gas, and so the combustion air can not be preheated and the heating without oxidation is limited to the temperature of 750° C., and if heating is required at higher temperatures, this burner is not applicable. In this point, the burner as shown in FIG. 3 may utilize the preheated air, and it is possible to heat without oxidation up to about 900° C. Further the temperature of the flame is heightened by this utilization of the preheated air, and the reducing action by the products in the intermediate reaction can be effectively increased in comparison with the radiant burner.

In the invention, the above mentioned heating burners of the reduction type are arranged in a line direction with spaces of (inner diameter of burner)/(pitch of burner) of more than 3.

According to the inventors' studies, it was found that if the burners were positioned with large spaces in the line direction, the steel band was oxidized by the combustion gas (hemiequilibrium gas) staying between the burners. The inventors investigated conditions for maintaining as a whole reduced the steel band which is reduced by the flame and oxidized by the combustion gas in relation with the inner diameter of the heating burner and the pitch thereof in the line direction.

It was found that the reduction rate A(T) of the steel band facing the non-equilibrium range and the oxidation rate B(T) thereof facing the oxidizing combustion gas between the heating burners were obtained by under equations. Each of the rates is applicable to the combustion gas of calorific value of 2000 Kcal/Nm$^3$.

$A(T)=127000\ e^{-(6433/T)}$ (Å/sec)

$B(T)=69200\ e^{-(6126/T)}$ (Å/sec)

Herein, T: Temperature of steel band (°K)

Assume that the inner diameter is d, the pitch of the heating burner is P and $\gamma=d/P$. For the steel band to be heated by the burners to maintain the reduced condition, an under mentioned formula must be established.

$$\gamma\cdot A(T)-(1-\gamma)\cdot B(T)\geqq 0 \quad (1)$$

Herein, A(T) and B(T) are functions of the temperature. According to said formula, B(T)/(A(T)+B(T)) is almost 0.3 within the temperature range of 0° to 1000° C.

$$\gamma \geqq \frac{B(T)}{A(T)+B(T)} \approx 0.3$$

FIGS. 1 and 2 show the disposing arrangements of the reducing burners (a), and FIG. 1 is a zigzag arrangement and FIG. 2 is a parallel arrangement. In each of the both arrangements, the burners (a) are placed so that the ratio d/P of the inner diameter d and the pitch p in the line direction is more than 0.3.

In the conventional burners used in, e.g., NOF, the non-equilibrium range is not formed distinctly from other ranges. Therefore, if an observable flame directly contacts the steel band, it is extremely oxidized, and generally the burners are positioned to make the flame parallel to the width of the steel band so that the flame does not directly contact it. On the other hand, the heating burners of reduction type to be employed in the invention are installed for heating the steel band by the non-equilibrium range to be formed in the length of the flame. For this purpose, the burners are positioned so that the flame collides to the steel band almost perpendiculaly in the non-equilibrium range.

BRIEF DESCRIPTION OF THE DRAWINGS

FIG. 3 is a vertically cross sectional view thereof and FIG. 4 is a cross sectional view seen from IV—IV line;

FIGS. 25 to 29 are graphs showing characteristics of the heating burner showin in FIGS. 3 and 4, wherein FIG. 25 is a relation between distance N from the burner exit, gas temperture, and $O_2$ concentration and ion strength, when a distance N in the burner axial direction between a fuel gas jetting outlet and an air jetting outlet is −0.25, and FIG. 26 is a relation between the distance N in the burner axial direction from the fuel gas jetting outlet to the air jetting outlet and free $O_2$ remaining distance L0 in the burner axial direction, and FIG. 27 is a relation between the distance L from the burner exit, gas temperature, $O_2$ concentration and ion strength, when the distance N is +0.1 D, and FIG. 28 is a relation between the fuel gas jetting outlet, the distance N of the air jetting outlet and temperature Tb of a rear wall of a burner tile, and FIG. 29 is a relation between the distance L from the air outlet to the burner exit and the distance $L_R$ till termination of the non-equilibrium range.

MOST PREFERRED EMBODIMENTS FOR PRACTISING THE INVENTION

Since the heating burners of reduction type are placed in said arrangements all over the available heating scope of the heating furnace by directly flaming, the steel band is always heated without causing oxidation but with causing reduction, whereby non-oxidation can be provided exactly.

Figure 7:
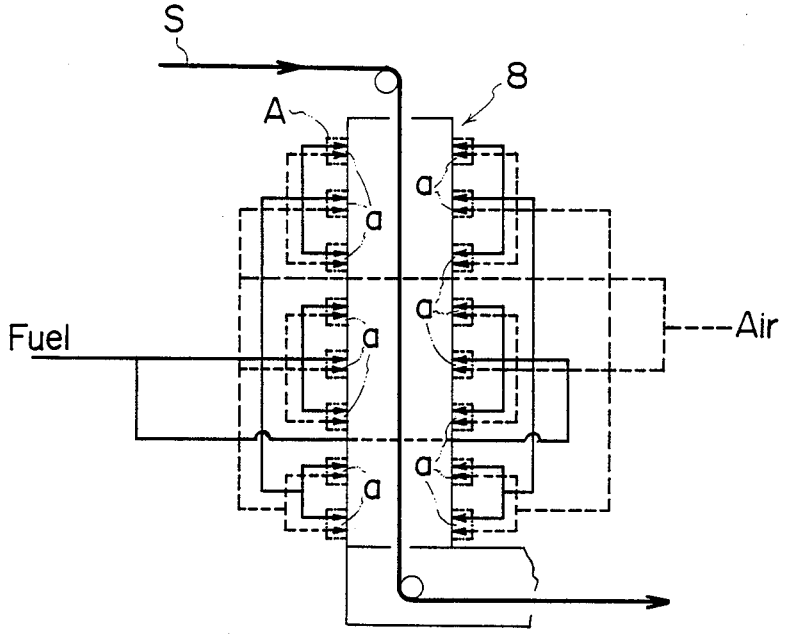
FIG. 7 is an explanatory view showing one embodiment of the invention.

FIG. 7 shows one example thereof, where said burners (a) are placed in the all available heating scope, i.e., all scope requiring the heating in a continuously heating furnace 8 of 1 PASS type, and it is seen that the heating burners (a) are positioned with spaces at both side in the length of the furnace.

Such heating burners of reduction type can heat the steel band all along under the non-oxidation in the all heating scope of the direct flame heating furnace. However, this kind of the burner is smaller in heat capacity than the ordinarily used burner of non-reduction type (diffusion burner), and if these burners are placed over the all heating scope, they should be close with next ones for keeping the required heat capacity.

Therefore, the present invention places said heating burners of reduction type in required and enough ranges (exit side) only, and places the burners of non-reduction type in the remaining ranges (entrance side).

The invention determines "non-oxidizing condition of the steel band" at least when the steel band gets out from the direct flame heating furnace.

Then, the invention adopts the basic disposing embodiment where the reduiction burners are disposed only at the determined scope in the exit side of the direct flame heating furnace, and the conventional non-reduction burners are disposed at the remaining parts in the length thereof, i.e., the entrance side, whereby the non-reduction burners at the entrance compensate the lack of the heat capacity of the reduction burners at the exit, and the oxidized film diposited on the steel surfce by the non-reduction burner is reduced by the reduction burner at the exit side, so that the steel band is transferred under the non-oxidation from the direct flame heating furnace.

That is to say, a plurality of the heating burners are placed all over the available length of the furnace, and with respect to said available length, the burners positioned in the furnace length at the exit side of more than $\gamma\%$ which is obtained by an under equation, are said reduction burners, and the burners positioned at the entrance side in the remaining length are said non-reduction burners.

$$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 $[=69200\ e^{-(6126/T)}]$ F(T): Heating rate (°K/sec) [=dT/dt]

The above mentioned composition determines the positioning scope of the reduction burners in order to make the thicknesses of the oxidized layer 0 by utilizing the reduction rate A(T) and the oxidation rate B(T) in the non-equilibrium range (reduction burner) of the reducing range in the flame and the semi-equilibrium range (non-reduction burner) of the oxidizing range.

The oxidation amount of the steel band within the furnace is determined by the contacting time with said both ranges, and according to the inventors' studies, it was found that said reduction rate A(T) and oxidation rate B(T) were obtained by the under equations. These rates are applicable to the combustion gas of calorie 2000 Kcal/Nm$^3$.

$A(T) = 127000\ e^{-(6433/T)}$ (Å/sec)

$B(T) = 69200\ e^{-(6126/T)}$ (Å/sec)

Herein, T: Temperature of the steel band (°K)

Therefore, assuming that T* is the temperature of the steel band at the boundary between the positioning ranges of the reduction burners and the non-reduction burners in the length of the furnace, the thickness of the oxidized film at the exit of the furnace can be obtained by the under formula.

$$\int_{T^*}^{T_{OUT}} A(T)\cdot\frac{dT}{F(T)} - \int_{T_{IN}}^{T^*} B(T)\cdot\frac{dT}{F(T)}$$

Herein, $T_{IN}$: Temperature of the steel band at an entrance of the direct flame heating furnace (°K)

$T_{OUT}$: Temperature of the steel band at an exit of the direct flame heating furnace (°K)

F(T): Heating rate (°K/sec) [=dT/dt]

It is possible to obtain the temperatures T* of the steel band at the boundary where the thickness of the oxidized film is 0 and since the steel band is considered to increase the temperature at a constant rate in the all available heating scope in length of the furnace, necessary part $\gamma\%$ of the reducing range in the full available length of the furnace for making the oxidized film zero, that is, of the range of the furnace length where the reduction burners should be placed, can be obtained by an under equation (2) from the temperature of the steel band at said boundary.

$$\int_{T^*}^{T_{OUT}} A(T)\cdot\frac{dT}{F(T)} - \int_{T_{IN}}^{T^*} B(T)\cdot\frac{dT}{F(T)} = 0 \quad (1)$$

$$\gamma = [(T_{OUT} - T^*)/(T_{OUT} - T_{IN})] \times 100 \quad (2)$$

In accordance with $\gamma$ calculated as above, the reduction burners are positioned in the length part at the furnace exit of the full available length, and the non-reduction burners are positioned in the remaining length.

Figure 8:
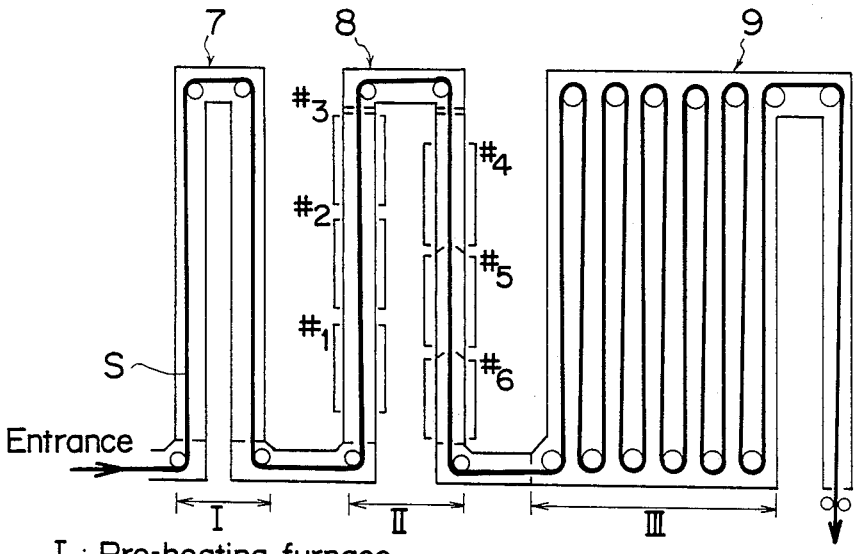
FIG. 8 is an explanatory view showing another embodiment of the invention.

FIG. 8 shows one example specified as above mentioned, where 7 designates the preheating furnace, 8 is the direct flame heating furnace, and (S) is the steel band.

The heating burners 8 to be disposed in the full available length of the furnace are divided into #1 to #6. For example, when the reduction heating range is required more than 24% of the all furnace length, the reduction burners are placed at #5 and #6 (range of about 30% of the full length), and the non-reduction buners are placed in the remaining #1 to #4.

Figure 9:
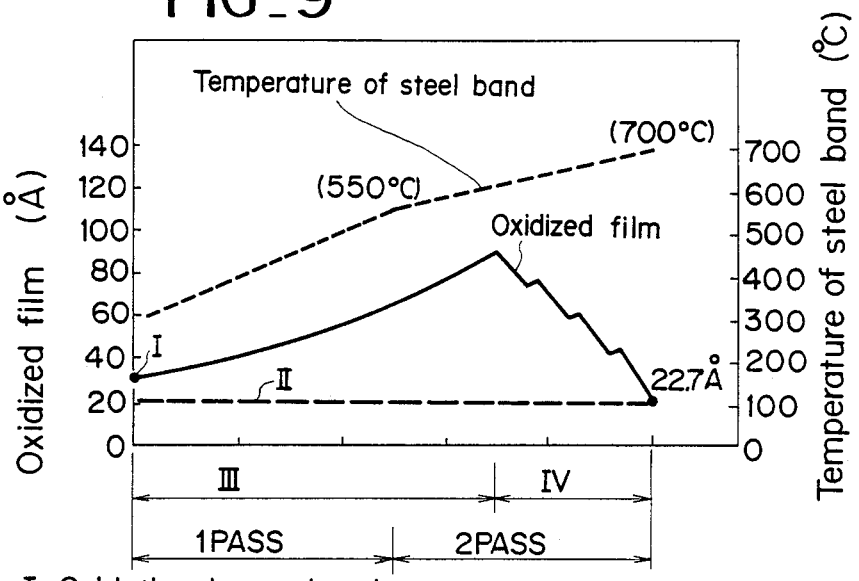
FIG. 9 is a graph showing transitions of actions of causing oxidizing film and temperatures of the steel band.

FIG. 9 shows one example of generation of the oxidized film and the transition of the temperature of the steel band, and it is seen that the oxidized film generated in the range (sligh oxidation heating range) where non-reduction burners are positioned, is reduced to the oxidized thickness of the base sheet in the range (reduction heating range) where the reduction burners are positioned, and the steel band is sent under almost non-oxidation.

Roll pickup due to the oxidation can be prevented if the the steel band is non-oxidized just before the passing rolls at the exit of PASS composing the direct flame heating furnace.

The invention sets said conditions, aiming at "non-oxidizing condition of the steel band". In this case, the reduction burners are with said pitch ((inner diameter of burner)/(pitch of burner)≧0.3) at the exit range of PASS including the heating range just before the passing rolls at the exit sides of PASSes of the direct flame heating furnace. In said composition, with respect to each of PASSes composing the direct flame heating furnace, the non-reduction burners of large heat capacity are positioned at the extrance side, whereby the calorie is fully kept, and the reduction burners which may reduce the oxidized film formed on the steel surface at the entrance heating range, are positioned, and the steel band is sent to a next PASS under the non-oxidizing condition or a soaking zone.

Figure 10:
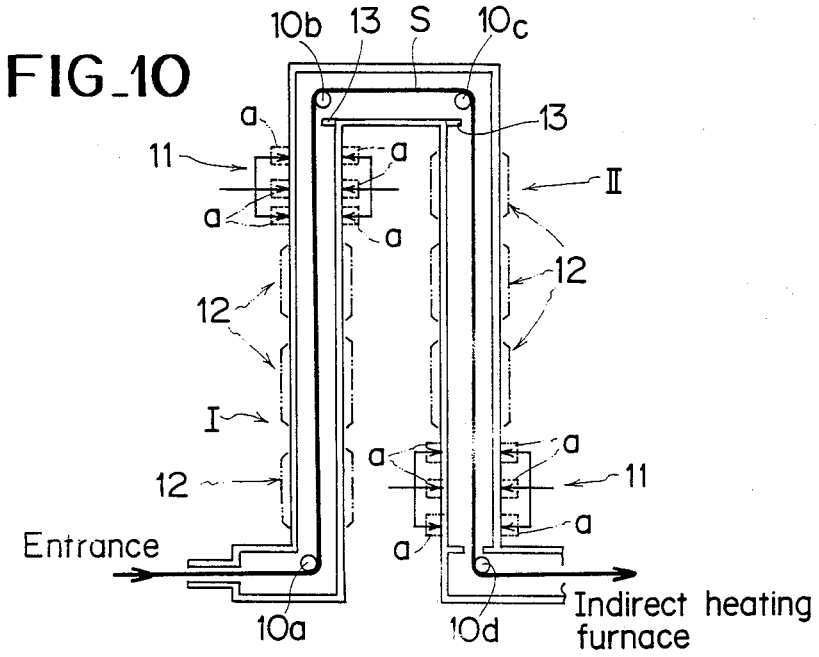
FIG. 10 is a cross sectional view showing another embodiment of the continuously treating line of the invention.

FIG. 10 shows one example thereof which is applied to the heating furnace of a 2 PASS type, where (I) is a 1st PASS, (II) is a 2nd PASS, and 10*a* to 10*d* are passing rolls. In this composition, heating groups 11 having a plurality of said reduction burners (a) in the line direction are disposed at the heating ranges just before the passing rolls 10*b* and 10*d* at the exits of PASSes, while heating groups 12 by the non-reduction burners are disposed in the remaining range.

Heating burner groups shown in FIG. 10 use burners of nozzle mix type and are placed so that a semi-equilibrium range thereof collides to the steel band.

In the present embodiment, shielding plate 13 are projected for protecting the passing rolls 10*b* and 10*c* from direct radiation from the furnace at the exit of the 1st PASS (I) and at the entrance of the 2nd PASS (II).

In such a heating furnace, the steel band (S) is oxidized to a certain extent by the heating burner groups 12 at the entrances and the intermediate ranges of PASSes, but the oxidized film is reduced by the heating burners 11 just before the pass rolls 10*b* and 10*d*, and passes the rolls 10*b*, 10*c*, 10*d* under the non-oxidizing condition and to the following indirectly heating furnace.

Figure 11:
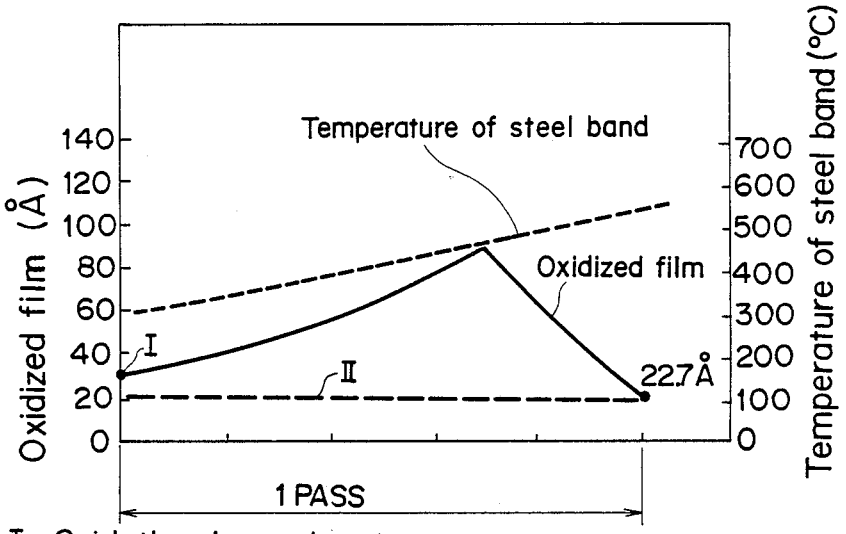
FIG. 11 is a graph showing transitions of actions of causing oxidizing fil and temperatures of the steel band.

FIG. 11 shows one example of generation of the oxidized film and the transition of the temperature of the steel band in the 1st PASS, and it is seen that the oxidized film generated in the range (slight oxidation heating range ) where non-reduction burners are positioned, is reduced to the oxidized thickness of the base sheet in the range (reduction heating range) where the reduction burnes are positioned, and the steel band is sent to the 2nd PASS under almost non-oxidation.

Temperatures of heating the steel band without causing oxidation but with causing reduction are about 900° C., and if the steel band is required to heat at higher temperatures, the indirectly heating furnace 9 may be installed next to the furnace 8.

The continuously treating lines the invention aims at will be two basic embodiments (though not excluding others) of a continuously annealing line and a continuously hot-dip zinc plating line.

An explanation will be made to the continuously annealing line.

There are embodiments of the continuously annealing line as follows;

(1) a line, which is provided, in order, with the direct flame heating furnace, the indirect heating furnace. and a cooling furnace where cooling is main for rolls, and is provided with a temper rolling machine at an exit of a finally treated steel finally treated steel band;

(2) a line, which is provided with a preheating furnace at an upper side of the direct flame heating furnace of the above line;

(3) a line which is provided with a cleaning facility at an upper side of the preheating furnace of the above line (2);

The steel band is performed with the reduction heating by the reduction burners in the furnace and sent to the indirectly heating furnace under the non-oxidizing condition. The steel band is heated and removed from a rolling oil in the heating furnace. In the subsequent indirectly heating furnace, the steel band is soaked in the reducing atmosphere. Since the steel band is sent into this furnace under almost non-oxidation, the atmosphere is sufficient with weak reducibility to an extent keeping the non-oxidation ($H_2$: 3 to 10%).

A following cooling furnace mainly cools the rolls, and at its rear side an overaging furnace is generally installed, and the steel band gets out from the cooling furnace and to a temper rolling machine.

In the indirectly heating furnace (soaking zone), it is possible to control $H_2$ concentration low, and since the steel band can be rapidly cooled to the overaging temperatures by cooling the rolls, the re-heating is no longer necessary for the overaging treatment, so that the energy is largely saved in comparison with the conventional annealing furnace. Further, by the heating without oxidation and the cooling rolls, the oxidation is avoided, and a pickling facility is not required at all.

Since the invention adopts the direct flame heating system excellent in responsibility of thermal load and the water cooling roll system easy in controlling the cooling cycle, the heating cycle can be exactly changed in accordance with a material or a desired property, and the steel band can be treated, irrespectively of the furnace temperatures, sheet thickness or width.

In the above line (2), the preheating furnace is installed in front of the heating furnace, and the steel band is preheated by an exhaust gas introduced from said furnace and guided to the heating furnace.

The heating time is short in the continuously annealing, and the operation is undertaken at higher temperatures than the batch annealing. Especially, in the facility having the direct flame reducing furnace as this invention, the operation is carried out, aiming at the high speed annealing, and the heating temperatures are set higher. By the preheating, the load for heating in the heating furnace is decreased, thereby to enable a desired high temperature and high speed annealing. The oxidation on the steel surface by the preheating is reduced by said heating furnace, so that the preheating is carried out at the high temperatures of 250° to 500° C. and the rolling oil is burnt thereby.

In the direct flame heating system, the heating rate is high so that the heating temperature (final temperature) is high and extra energy is required as much accordingly, but by preheating the gradient of rising temperature is lowered and the heating temperature is not heightened more than required.

In the above line (3), the cleaning facility is installed in front of the preheating furnace, which mainly removes iron powders attached to the steel surface. The surface of the steel band having been cold rolled is attached with rolling oils, iron powders (rolling dusts) and others. The rolling oil is burnt away as said above, but the iron powders are accumulated or circulated together with the atmospheric air in the furnace and kept between the roll and the steel band and makes flaws on the steel surface. In this facility, the iron powders are removed by said cleaning instrument.

In case the continuoulsy annealing is performed on the steel band of high Si, P, Mn, Ti, Cr, and since these elements cause oxidized films which are difficult to be reduced, the air ratio of the combustion gas is often lowered in order to lighten oxidation by the preheating and the direct flame heating (heating prior to reduction heating). Then, the burningoff characteristic of the rolling oil on the steel surfce is more or less lowered but said cleaning instrument compensates said lowering.

Figure 12:
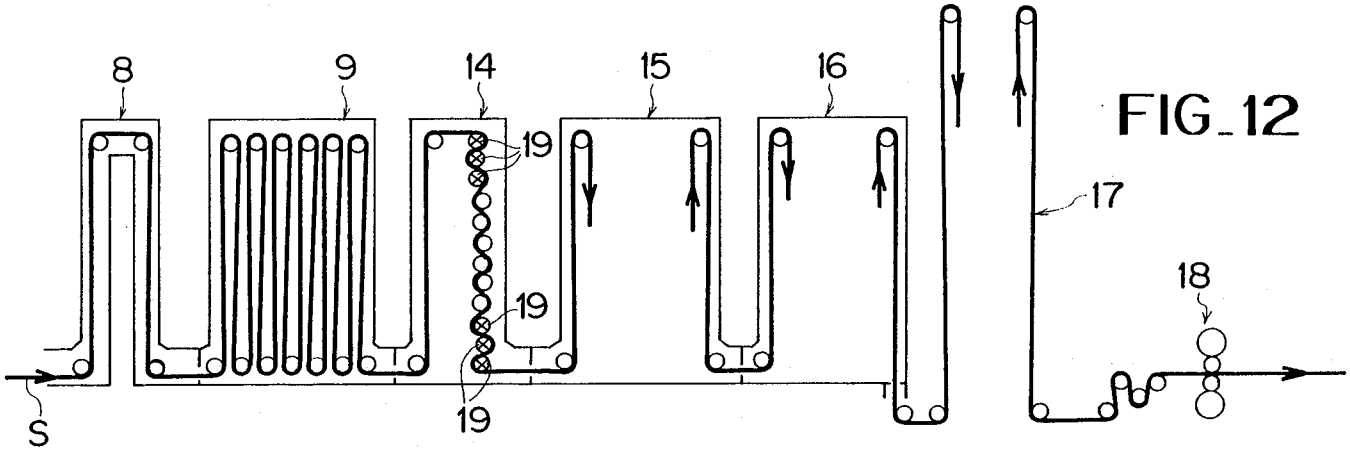
FIGS. 12 to 14 are respectively explanatory views showing embodiments of the continuously treating lines of the invention.

FIG. 12 shows an embodiment corresponding to the above line (1), and there are installed the direct flame heating furnace 8, indirectly heating furnace 9, colling furnace 14, overaging furnace 15 and a finally cooling furnace 16 in order from the entrance side, and at the exit of the furnace 16 the temper mill 18 is disposed.

The indirectly heating furnace 9 is a the radiant tubes as conventionally. In this annealing line, the direct flame heating furnace 8 has the reducing function and the steel band is transferred to the indirect heating furnace 9 under the non-oxidizing coindition, and therefore this furnace 9 is enough with such an atmosphere to an extent that the steel is not oxidized, that is, the atmosphere of $H_2$: 3 to 10% preferably 4 to 6%.

In the cooling furnace 14, a plurality of cooling rolls 19 (ordinarily, water cooling roll) are provided and a contact length of the cooling rolls 19 to the steel band is changeable, so that the temperature may be controlled at cooling end.

It is preferable to use chrom rolls of hard property for the woke rolls of the temper mill 18. Especially preferable rolls are seen in Japanese Patent Applications No. 41009/85 and No. 41011/85. The rolls therein are difficult to have pressing flaws by the steel edges, and the steel surface is exactly prevented from scratches by flaws of the rolls, and coarse printing to the steel band may be kept, so that the continuous annealing of cycle free in the width of the steel band is possible. In the prior art, in order to prevent influences of the edge marks or roll flaws, steel bands to be treated are combined in that the steel widthes are narrower successively. By using the hard chrom rolls, restrictions as mentioned are are released, and the steel bands can be combined, irrespectively of of the wide sizes.

Figure 16:
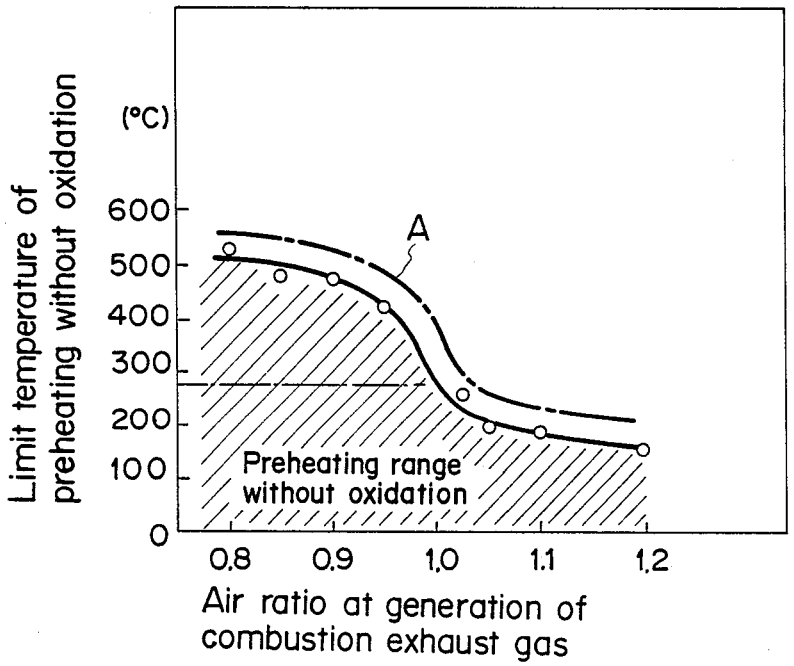
FIG. 16 is a graph showing a relation between an air ratio of combustion exhaust gas and limit temperature of preheating without causing oxidation within the preheating furnace of FIGS. 13 and 14.
Figure 13:
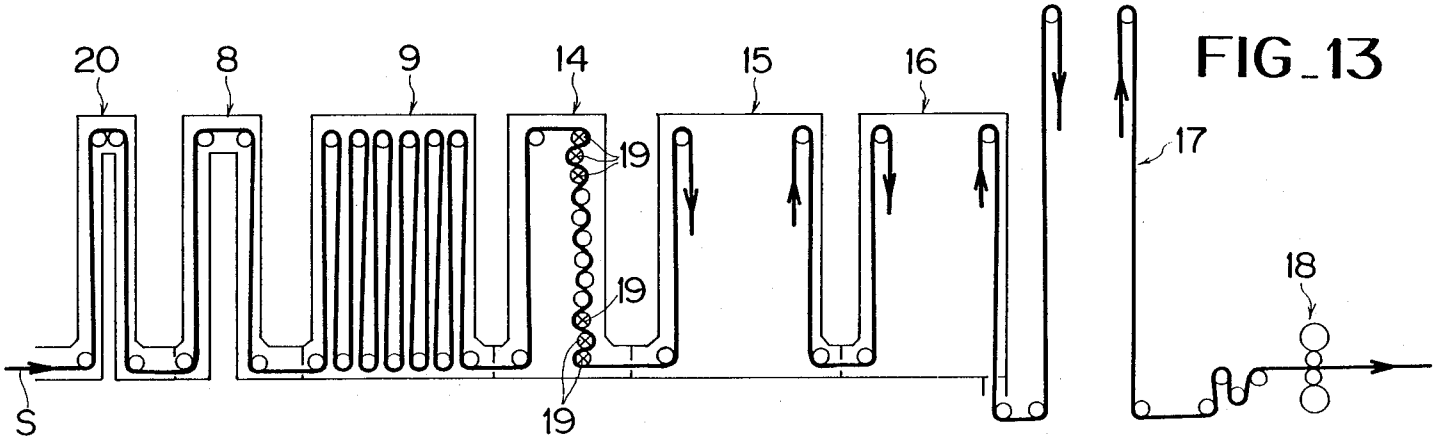

FIG. 13 shows an embodiment corresponding to the above line (2), and the preheating furnace 20 (2 PASS) is placed before the direct flame heating furnace 8, into which the combustion waste gas is introduced from the furnaces 8 or 9 so as to accelerate the preheating of the steel band (S). According to the inventors' investigations, it was found that the oxidation of the steel band was regulated by the preheating temperature and the air ratio when the combustion exhaust gas was generated, and the steel band could be preheated with scarecely causing oxidation by using, in response to the preheating temperature, the combustion waste gas which was different in the air ratio when the combustion took place, and concretely, if the combustion waste gas generated at the air ratio of more than 1.0 was used, when the steel band was preheated as shown in FIG. 16 in the range of less than 280° C., and if the combustion waste gas generated at the air ratio of less than 1.0 was used, when preheating more than 280° C., the steel band could be preheated effectively with almost non-oxidation, irrespectively of the preheating temperatures.

As seen above, the preheating without causing oxidation is possible in the preheating furnace 20 by regulating the air ratio of the combustion gas. In the following furnace 8, since the oxidized film is reduced, oxidation to a certain extent is permitted in the preheating furnace 7, and as a result, the preheating allowance temperature can be heightened about 50° C. as shown with a chain line A of FIG. 16, whereby it is possible to perform the preheating of about 400° C. even at the air ratio of about 1.0, and burn off the rolling oil from the steel surface.

Figure 14:
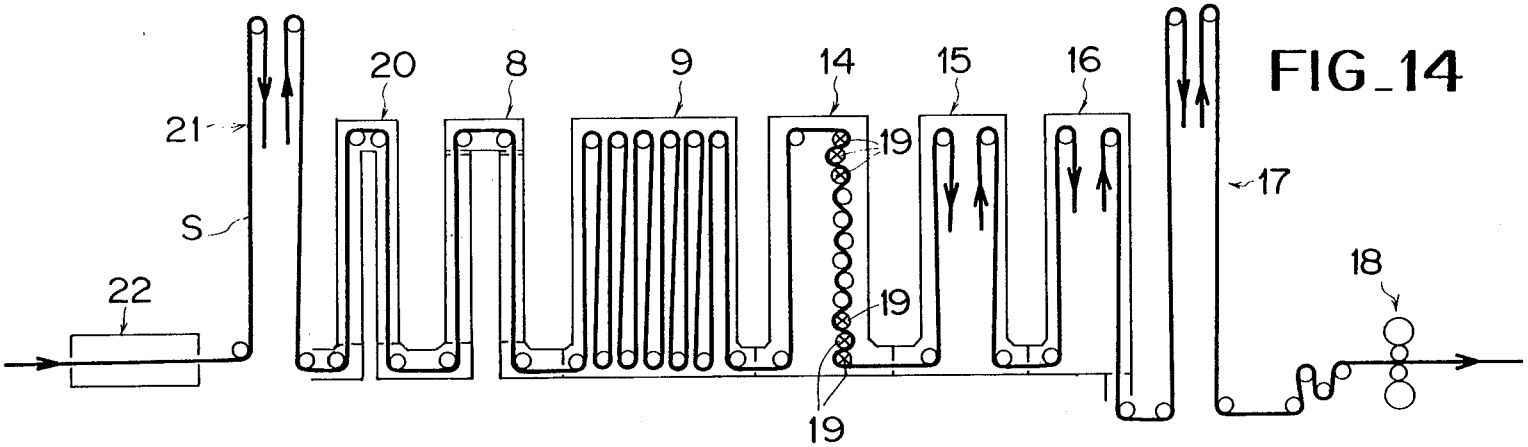

FIG. 14 shows an embodiment corresponding to the sbove line (3), and the cleaning facility 22 is provided before the preheating furnace 20 via an entrance looper 21 in order to remove the iron powders. This facility 22 may be easy, since it aims at removing iron powders or dusts.

Figure 15:
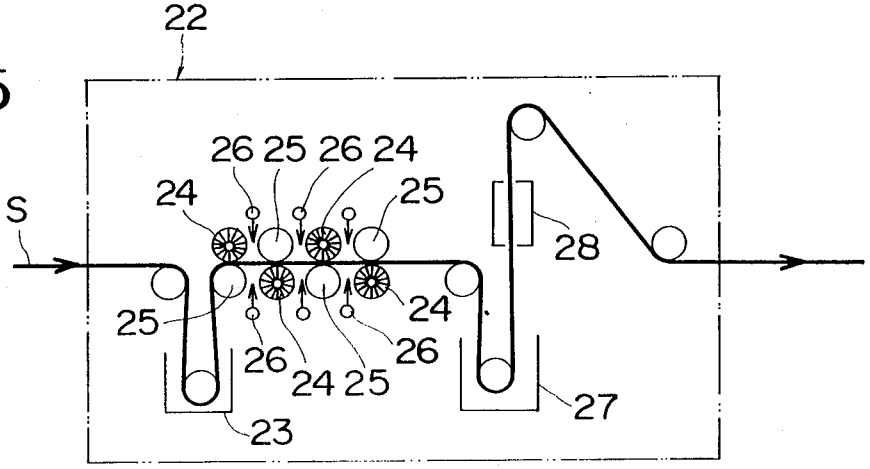
FIG. 15 is an explanatory view showing in details a cleaning facility within the line of FIG. 14.

FIG. 15 shows one example of the cleaning facility, where 23 is an alkaline chamber, 24 is brush rolls, 25 is backup rolls, 26 is hot water spray nozzles, 27 is a hot water rinse chamber, and 28 is a dryer. By this facility, the iron dusts or powders are cleansed.

Other examples of the continuously annealing line are, (4) a line, which is provided, in order, with the direct flame heating furnace, the indirect heating furnace and a cooling where finally treated steel band;

(5) a line, which is provided with a preheating furnace at an upper side of the direct flame heating furnace of the above line (4); and (6) a line which is provided with a cleaning facility at an upper side of the preheating furnace of the above line (5). Passing through these lines, the steel band may be continuously annealed efficiently without problems arising about oxidation.

In these compositions, the steel band is subjected to the non-oxidation but reduction heating as in the above lines (1) to (3) and to the soaking with the reducing atmosphere in the indirectly heating furnace. Since the steel band is sent to the indirectly heating furnace under almost non-oxidized condition, and removed of a new oxidized film caused by the liquid cooling at the intermediate pickling, the atmosphere therein is sufficient with weak reducibility to an extent of maintaining the non-oxidation ($H_2$: 2 to 5%). In the cooling furnace, rapid cooling is undertaken with liquid, and the steel band is cooled to the room temperature, or overaging or tempering temperatures by the hot water. Thus the steel band is removed of said oxidized film and performed with the overaging or tempering treatment in the overaging furnace, and is treated by the temper rolling machine after the final cooling zone.

Although said continuously annealing facility carries out the rapid cooling with the hot water or cold water after the heating and soaking, the steel band of high surface quality may be produced by using the direct flame heating furnace which enables the non-oxidation heating. In other words, if the cooling after the heating and soaking is performed with the water, the oxidized film is inevitably formed on the steel surface. In the conventional combination of the direct flame heating furnace and the liquid cooling system, even if the reducing furnace is provided after the direct flame heating furnace, the oxidized film remains and a further oxidized film is formed by the liquid cooling. Such phenomena are remarkable in the materials of high Si, Mn, P, Cr or Ti which generate strong oxidized films.

In this point, in the present continuous annealing line, the steel band is sent, under non-oxidizing condition, from the direcr flame heating furnace which enables reduction heat to the indirect heating furnace—the cooling furnace, the intermediate pickling facility is sufficent only to remove the oxidized film created by the rapid cooling, and it is perfectly removed by the pickling.

Further, this line is provided with the intermediate pickling facility before the overaging furnace in addition to the final pickling facility, thereby to heighten the removing effect of oxidized film. In the pickling, if strong acid is used, there arises a problem that $Fe(OH)_2$ harmful to the surface treatment is gererated. If the pickling is done at the final side, i.e., after the overaging furnace, $Fe(OH)_2$ stays on the steel surface as it is, and this causes various troubles to the modifying treatment of the steel band. In this regard, the instant line is provided with the pickling facility before the overaging furnace, and $Fe(OH)_2$ generated does not remain, since it is reduced by the reducing atmospheric gas within the subsequent overaging furnace, and therefore the pickling with a strong acid is substantially possible. Further, if the annealing is carried out at the high temperature by directly flaming, the steel band is often attached with a bit of carbon on its surface, but this carbon could be removed by the intermediate pickling.

In the line (5), the preheating is done in the preheating furnace as in the line (2), and in the line (6) the treatment is done in the cleaning facility as in the line (3).

Although the steel surface is oxidized by the preheating, and as the direct flame heating furnace is provided which can reduce this oxidation and the intermediate pickling chamber is provided, the preheating can be performed at the higher temperatures as 250° to 600° C. in the preheating furnace.

In the direct flame heating furnace, the zone of the reduction burners must always keep the combustion for performing the reduction heating on the steel surfce, the thermal load of the heating furnace due to differences in thicknesses of the steel bands is controlled by extinguishing the burners of other zones, but if the preheating is provided with an auxiliary combustion furnace, a delicate control of the thermal load may be effected in the heating of thin materials.

Figure 17:
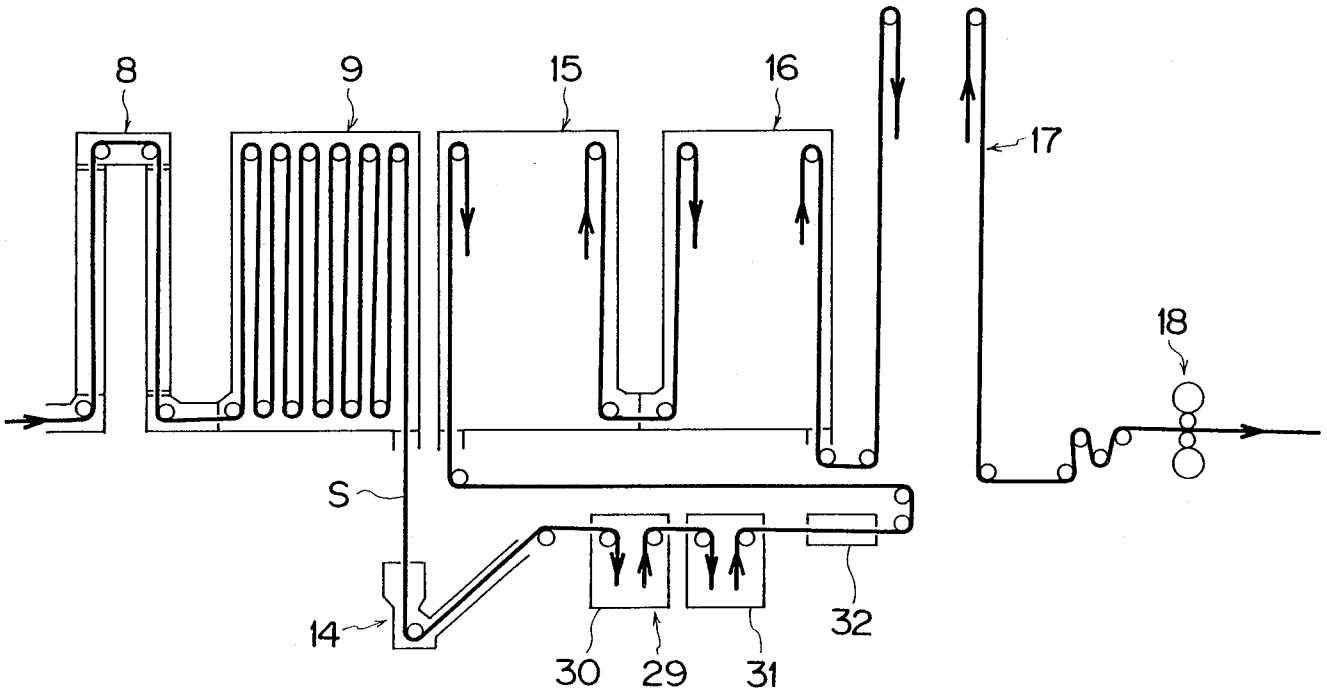
FIGS. 17 to 19 are explanatory views showing embodiments of the continuously treating lines of the invention.

FIG. 17 shows an embodiment corresponding to the line (4), where from the entrance side disposed are the direct flame heat furnace 8, indirect heat furnace 9, cool furnace 14, intermediate pickling 29, overage treatment 15 and final cool furnace 16. At the exit side of the final cooling furnace 16, a temper mill 18 is placed.

The indirectly heating furnace 9 is the radian tube system as mentioned above, and the intermediate pickling is provided and therefore the soaking zone is sufficient with the atmosphere to an extent not oxidizing the steel band, $H_2$: 2 to 5%, preferably 3 to 4%.

The steel band (S) is rapidly cooled by immersion into the water in the cooling furnace 14. In the water a nozzle sprays to the steel band to remove the steam film.

The intermediate pickling facility 29 comprises a pickling chamber 30, rinse chamber 31 and dryer 32. For example, the pickling treatment is HCl 5% and 40° to 60° C.×1.5 sec, and the water rinse is 80° C. water. In the overaging furnace 15, the steel band (S) is subjected to the overaging treatment or the tempering treatment in the weak reducing atmosphere. It is preferable to use the same temper mill 18 as said in the line (1).

Figure 18:
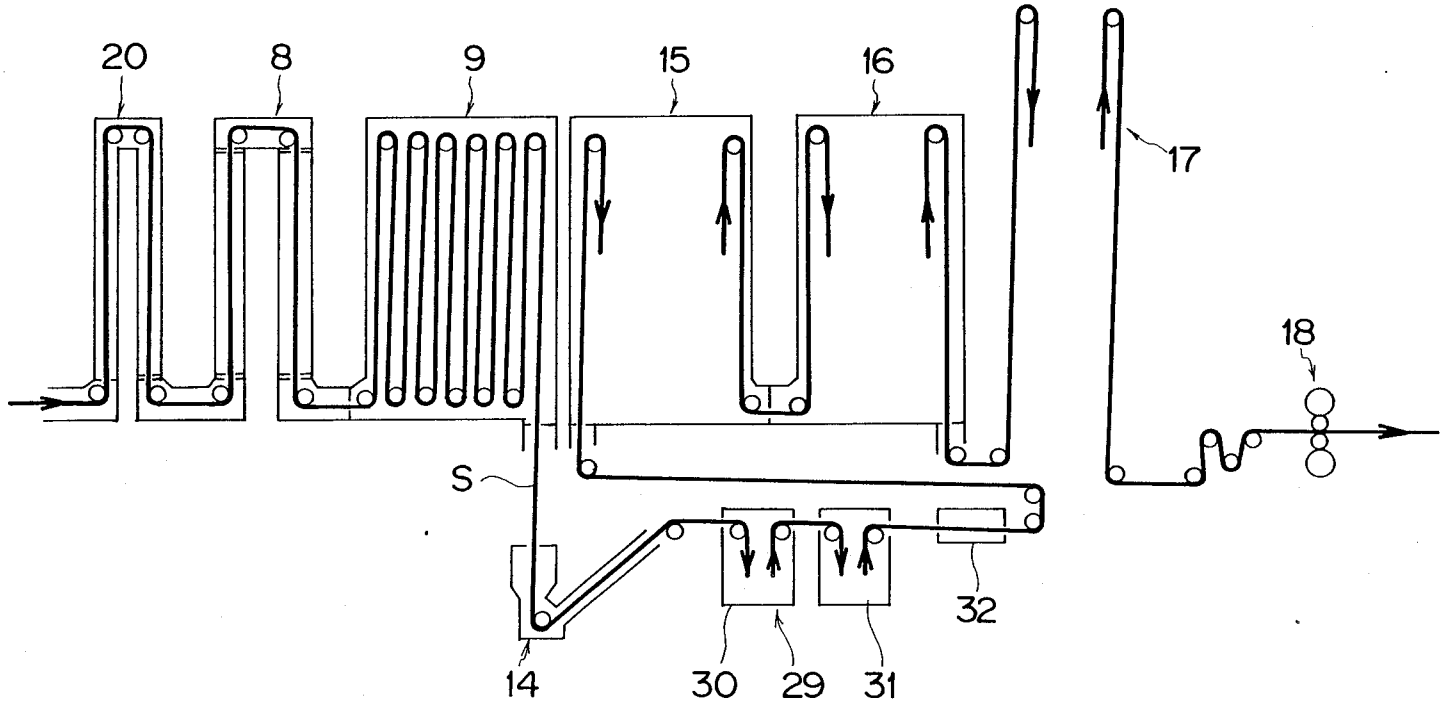

FIG. 18 shows an embodiment corresponding to the line (5), where the preheating furnace 20 is provided before the direct flame heating furnace 8, and this preheating furnace is as said above in the line (2).

Figure 19:
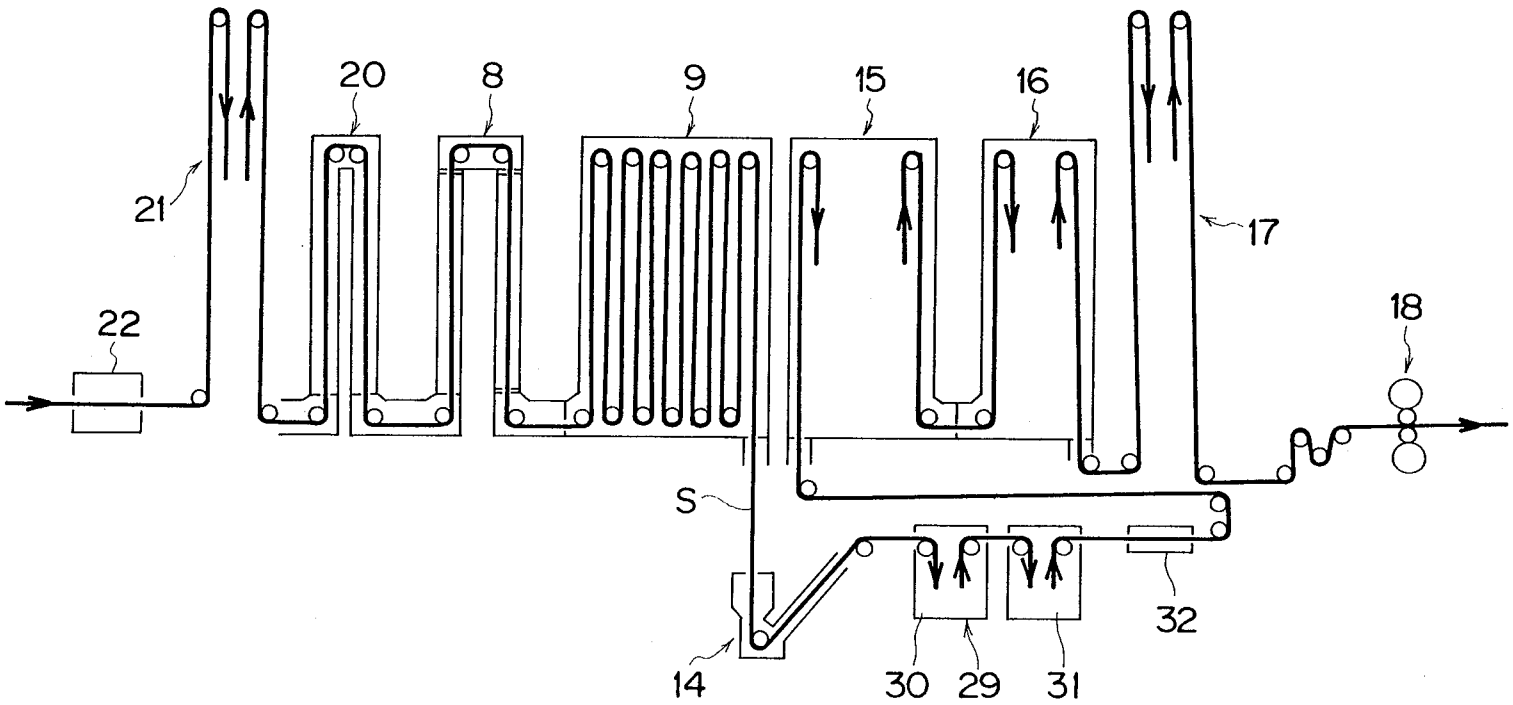

FIG. 19 shows an embodiment corresponding to the line (6), where the cleaning facility 22 is provided before the preheating furnace 20 via the entrance looper 21, and this cleaning facility is as said above in the line (3).

As the temper rolling machine in the lines (1) to (6), a tension leveller may be used in addition to the temper mill. After the cooling facility, a plating apparatus as a zinc plating apparatus may be employed.

If the present invention is applied to the continuously annealing line, a following heat cycle will be adopted. After heating in the direct heating furnace, the steel band is maintained at a determined temperature range for more than 5 seconds in the heating and soaking furnace of the indirect heating. Nuclei of crystal grains appear and grow after recrystalizing temperature is over in a last half of the heating zone, and said soaking time is the shortest time for crystal grains to grow up to determined grain diameter.

The steel band heated and soaked as said is, if required, maintained till the determined temperature, and rapidly cooled at more than 40° C./sec. For improving the aging property of the product, solute C effected by the heating and soaking should be precipitated for a period of time as short as possible in the overaging furnace, following the rapid cooling. The above cooling rate is necessary for producing solute C in an oversaturated condition so as to realize said precipitation of short time. The faster is the cooling rate, the higher is the degree of oversaturation, and the overaging time is shorter. Thus, the minimum cooling speed is regulated. The steel band having passed through a continuous heating treatment becomes a product, after the overaging treatment—final cooling, if required.

The under mentioned (1) to (7) show actual heating cycle of the continuous annealing line comprising the preheating furnace—direct flame heating furnace—indirectly heating furnace furnace—gas jet cooling furnace—roll cooling furnace—overaging furnace—finally cooling furnace.

(1) Preheating furnace: using the combustion exhaust gas of 1200° to 1400° C. from the direct flame heating furnace for preheating the cooled steel band to 250° to 330° C.;

(2) Direct flame heating furnace: reducing the preheated steel band to 430° to 800° C. by means of the direct flame heating burners;

(3) Indirect heating furnace: since the heating of the direct flame heating furnace is limited up to 900° C., and if heating of more than 900° C. is required, such heating is made in this furnace. When the steel band comes up to the upper limit, it is 5 to 120 seconds in the weak reducing atmosphere;

(4) Gas jet cooling furnace: moderately cooling the steel band in the soaking zone to temperatures of starting rapid cooling (550° to 750° C.);

(5) Roll cooling furnace: contacting the steel band to the water cooled rolls so as to rapidly cool it to 250° to 400° C. at more than 40° C./sec for temping;

(6) Overaging furnace: performing the overaging treatment by maintaining the steel band at 400° to 150° C. for more than 30 seconds;

(7) Finally cooling furnace: cooling the overaged steel band less than 150° C. and leaving it in the air.

A further explanation will be made to another basic embodiment of a continuously hot-dip zinc plating line.

Figure 20A:
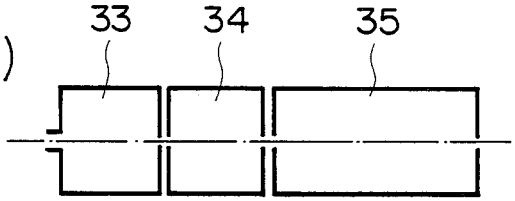
FIGS. 20(A) and (B) are explanatory views of continuously hot-dip zinc plating lines of the invention.

FIG. 20(A) shows one example of the continously hot-dip zinc plating line, where 33 is a direct flame oxidizing furnace, 34 is a direct reduction furnace, 35 is a soaking furof indirectly heating system, and a hot-dip zinc plating furnace is installed after the soaking furnace 35. The furnace 34 is arranged with the above mentioned reduction heating burners with the determined spaces.

Figure 20B:
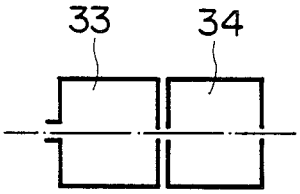

FIG. 20(B) shows another example of the same, where the soaking furnace is not located, and the plating apparatus is placed after the direct flame reduction furnace 34. In this line, the steel band (S) is perfectly heated and soaked in said furnaces 33 and 34.

Therein, the steel band (S) is at first subjected to the direct flame heating in the direct flame oxidizing furnace 33 and removed of the oil, and is oxidized. Subsequently, the steel band is forcibly subjected to the direct flame reduction heating in the reduction furnace 34 and is removed of the oxidized film generated on the steel surface. Thus, the forcible oxidation - forcible reduction are effected with the oxidation in the direct flame oxidizing furnace.

After said heating, in the line as shown in FIG. 20(B), the steel band is instantly immersed into a zinc pot.

In the line of FIG. 20(A), the steel band is heated in the oxidation furnace 33 and the reduction furnace 34 up to a determined temperature, and sent to the soaking furnace 35 under the non-oxidizing condition. This soaking furnace 35 is the indirect heating system, but since the steel band from the reduction furnace 34 is non-oxidized, it does not require in principle the reducing gas and the atmosphere gas is enough with an inert gas. However, actually, due to leakage in the furnace, it is preferable that $H_2$ stays there and compensate it, to the extent of not more than 5%.

Figure 21:
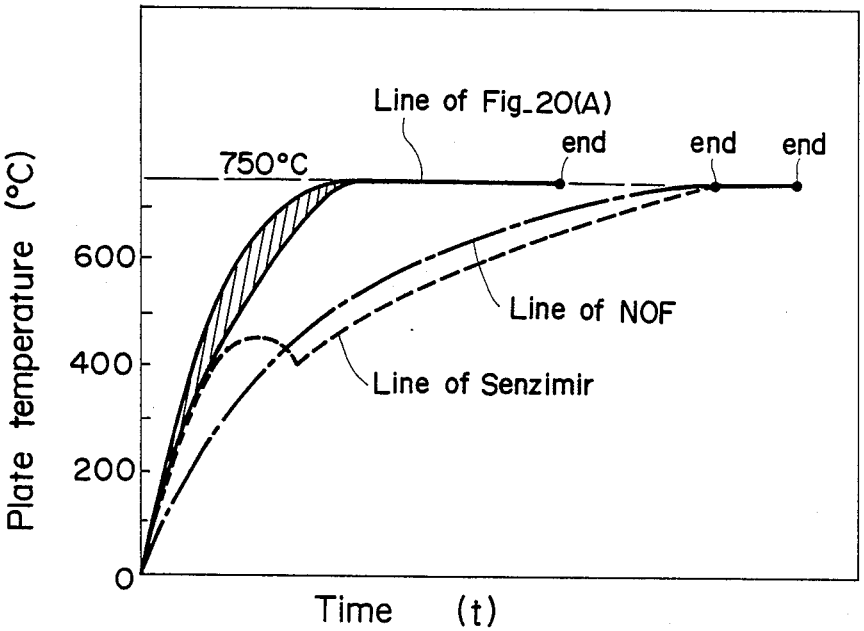
FIG. 21 is a graph comparing the plating line of FIG. 20(A) and foregoing plating lines with respect to curves of increasing temperatures of the respective annealing cycles.

FIG. 21 compares the line of FIG. 20(A) and the conventional lines (Senzimir and NOF ) with respect to the curves of the rising temperatures of the annealing cycles. In FIG. 20(A), the heating is made by directly flaming, and the heating efficiency is higher than the conventional ones, and heating comes up to the determined temperature in a short period of time. As a result, the furnace length is shortened largely.

In addition to the basic structure of the above said direct flame heating furnace, the under mentioned compositions may be employed.

(1) In a line having the direct flame heating furnace and an atmosphere furnace, the atmosphere furnace is provided with a seal chamber at an upper part of sealing rolls at an exit for preventing invasion of the air into the atmosphere furnace, and provided with a means for detecting pressure in said atmosphere furnace and a means for blowing the sealing gas into the sealing chamber when the furnace pressure is decreased.

(2) In a line having the preheating furnace, the direct flame heating furnace and the indirectly heating furnace, an intermediate chamber is provided between the furnaces for preventing the furnace gas from moving into other furnace, and mutual interference between the furnaces due to changes in the furnace pressure.

(3) In a line having the preheating furnace, the direct flame heating furnace and the indirectly heating furnace, an after-burning chamber is provided between the direct flame heating furnace and the preheating furnace, which perfectly burns the combustion exhaust gas within the heating furnace and supplies it into the preheating furnace, in addition to the object said above (2), for effectively preheating the steel band by utilizing the combustion exhaust gas.

Figure 22:
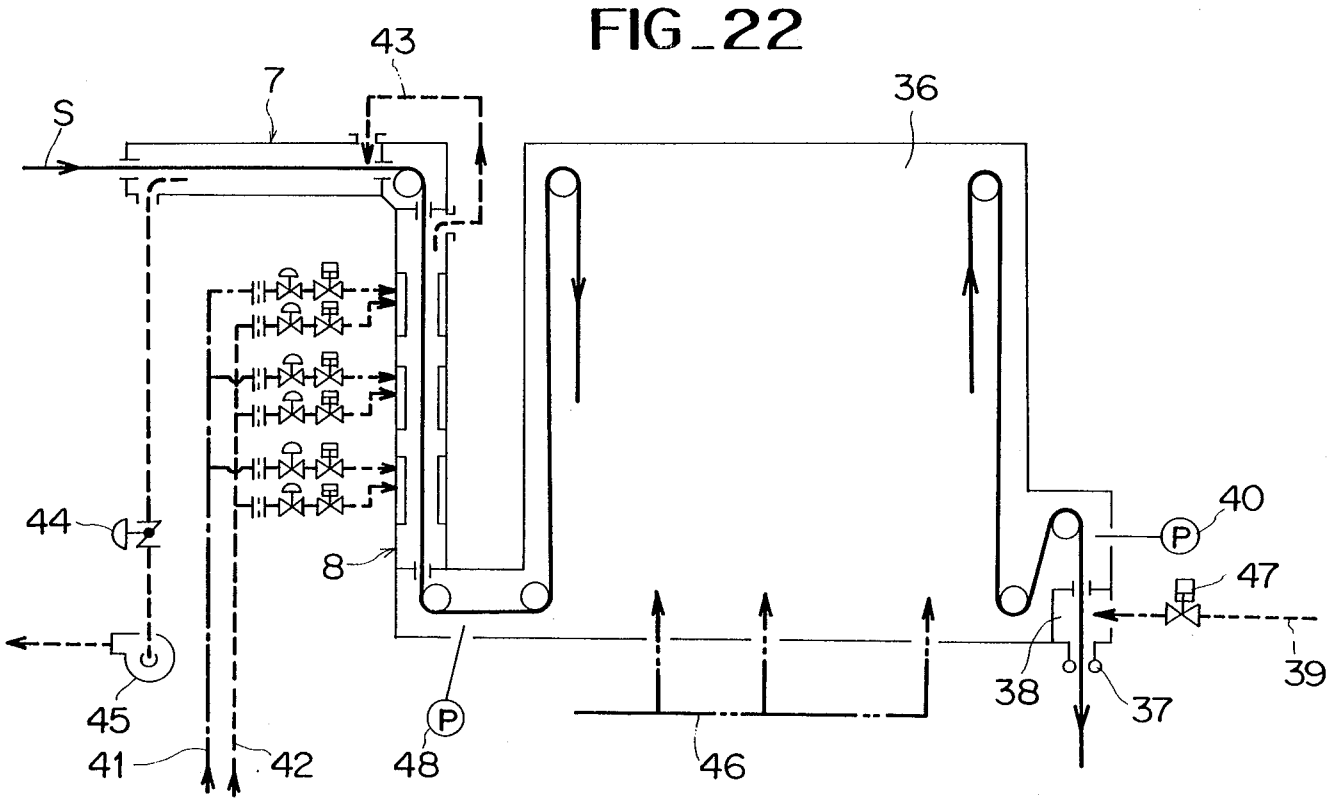
FIG. 22 is an explanatory view showing another embodiment of the present inventive line.

FIG. 22 shows one example of the above line (1). The line has, in order from the entrance, the preheating furnace 7, the direct flame heating furnace 8 and the atmosphere furnace 36. The atmosphere furnace 36 has the soaking and, the cooling zones, and if required, an overaging zone.

The atmosphere furnace 36 is provided, at its exit, with the seal rolls 37 and a seal chamber 38 is furnished above the rolls 37. The seal chamber 38 is provided with a sealing gas blowing device 39, and a pressure gauge 40 is provided for measuring the furnace pressure.

The steel band (S) passes through the preheating furnace 7, heated up to 500° to 800° C. in the non-oxidation or the reduction, heated to higher temperature in the atmosphere furnace 36, and subjected to the soaking, rapid cooling and overaging, and rapidly cooled less than about 150° C., and taken out from the furnace after the sealing rolls 37.

In the direct flame heating furnace 8, the combustion gas at high temperature is supplied to the burners by the fuel gas 41 and the combustion air 42. The combustion gas directly collides to the steel band to heat it to the determined temperature, and after then it becomes an exhaust gas 43 and preheats the steel band to 200° to 450° C. in the preheating furnace 7 and exhausted from a chimney via a furnace pressure control damper 4 and an exhaust fan 45.

Between the heating furnace 8 and the atmosphere furnace 36, a passage is provided for preventing invasion of the combustion exhaust gas into the atmosphere furnace, but this passage should have an enough size for passing the steel band (100 mm×2000 mm). The passage does not serve the gas sealing, and accordingly variances in pressure of the heating furnace 8 will be variances in pressure of the atmosphere furnace 36. Therefore, a furnace pressure gauge 48 is positioned at a post where the atmosphere gas 46 flows to the heating furnace 8 from the atmosphere furnace 36, and a furnace pressure control damper 44 controls the pressure therein to be +5 to 15 mmWC.

The furnace pressure can be maintained constant, but when the combustion in the direct flame heating furnace 8 is changed, e.g., when one of the plural zones is extinguished, it is often late to close the furnace pressure control damper 44, so that the pressure in the atmosphere furnace 36 is negative for a short period of time (around 5 to 10 seconds). In this case, the seal rolls 37 are prepared for a part of the steel band (S) which gets out from the atmosphere furnace 36, but a large space is formed at said part and the air easily invades thereinto.

In the invention, a sealing chamber 38 is provided at an upper part of the sealing rolls 37 in order to avoid the invasion of the air. A distance between the sealing chamber 38 and the atmosphere furnace 36 is throttled, so that the gauge 40 detects the pressure-down of the atmosphere 36 (e.g., lower 5 mmWC than a determined pressure), and in this interval the sealing gas is blown into the sealing chamber 38 from a blowing device 39. Said sealing gas may be sole $N_2$ or an atmosphere gas containing $H_2$ 3 to 20%. The blowing amount of the seal gas is enough with 300 to 600 $Nm^3/l$ for 10 to 20 seconds, though depending upon the throttling size.

Since it is necessary to continuously blow a bit of N or the atmosphere gas even in the normal time, an interrution valve 47 should be equipped with a bypath pipe of small diameter, or another pipe should be connected to the sealing chamber.

Figure 23:
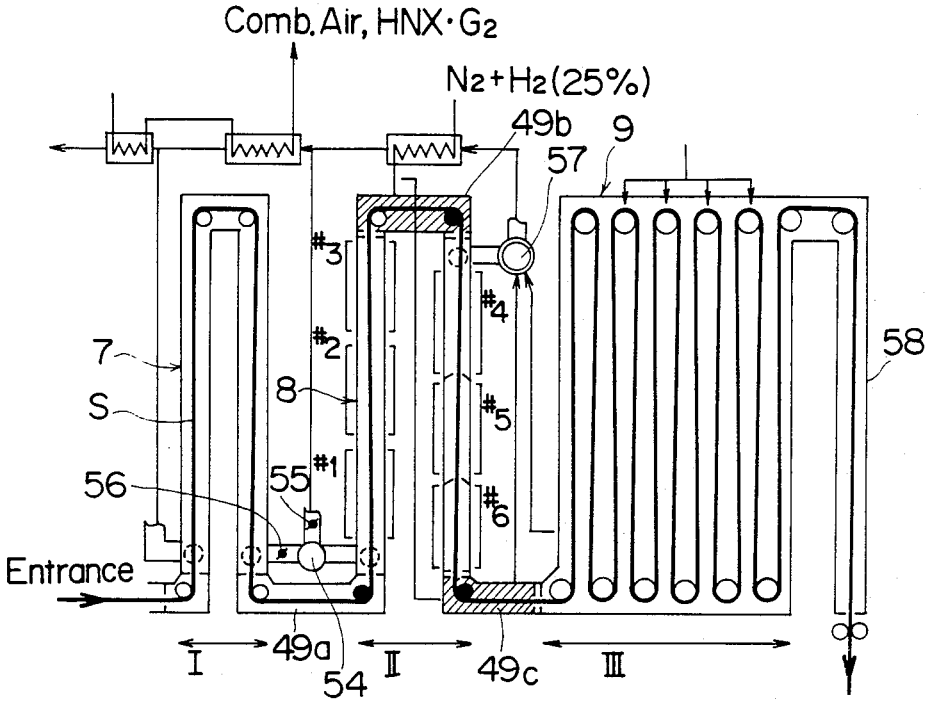
FIG. 23 is an explanatory view showing a further embodiment of the invention.

FIG. 23 shows an embodiment of the above lines (2) and (3).

This continuous line has, in order from the entrance side, the preheating furnace 7, direct flame heating furnace 8, indirectly heating furnac 9 and gas jet cooling furnace 58. After the cooling furnace 58, there are installed a cooling furnace by roll cooling, an overaging furnace and exit facility. A 1st intermediate chamber **49*a* is positioned between the preheating furnace 7 and the heating furnace 8, a 2nd intermediate chamber 49*b* is positioned at an upper turning point of the heat furnace 8, and a 3rd intermediate chamber 49*c* is positioned between the heat furnace 8 and and indirect heat furnace 9**.

Figure 24:
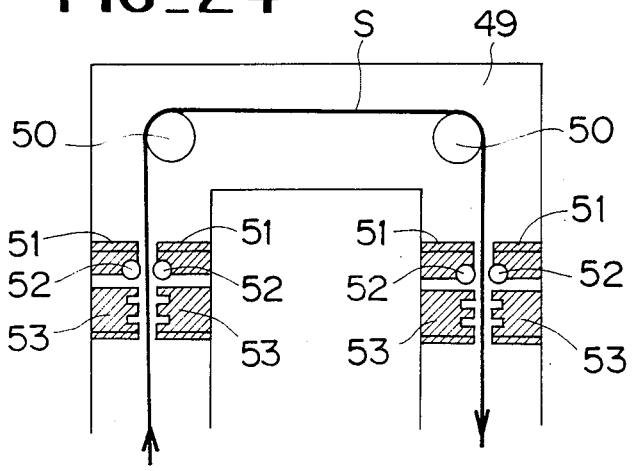
FIG. 24 is a partially enlarged view of an intermediate chamber within the line of FIG. 23.

A detailed explanation will be made to the structures of the intermediate chambers **49*a*, 49*b*, 49*c*, referring to FIG. 24. 49 designates the intermediate chamber, 50 shows rolls holding the steel band (S), 51 is sealing plates with a space therebetween via the steel band (S), 52 is sealing rolls, 53 is labyrinth seals via the steel band (S). A distance between the seal rolls 52 may be approached till a few millimeters. The sealing rolls may depend upon an inner cooling or the water cooling. If the water cooling is not done, the rolls of heat resisting steel or ceramics will be used. The Labyrinth seal 53 is made of the heat resisting material, and protects the sealing roll 52 from the heat radiation from higher temperature in the frunace. The sealing plate 51 is used as a final seal and is not always required, but it is positioned just after the sealing roll 52 and it can be brought very nearly to the steel band (S). This is a large sealing effect. A distance between the sealing plate 51 and the labyrinth seal 53 is around 50 to 100 mm. In these sealings, the labyrinth seals 53 make rough sealing, and the seal rolls 52 make normal sealing ,and the seal plates 51** make a further sealing.

In FIG. 23, the temperature of the 1st intermediate chamber **49*a* is not so high but around 300° C., and a measure for protecting the rolls is not especially necessary. The amosphere in the 1st intermediate chamber 49*a*** may be a reducing gas ($H_2+N_2$) or the combustion exhaust gas. Sealings are enough required to separate independent furnaces.

In FIG. 23, the heating furnace is composed of two PASSes between which the intermediate chamber **49*b* is positioned. The reducing atmosphere ($H_2+N_2$) is preferable in the 2nd and 3rd chambers 49*b* and 49*c* for protecting the rolls, and especially the 3rd chamber 49*c* must have the reducing atmosphere for preventing the exhaust gas of the heating furnace from entering into the indirect heat furnace 9**.

Between the direct flame heating furnace 8 and the preheating furnace 9, there is provided an after-burning chamber 54 which perfectly burns the combustion exhaust gas of the heating furnace 8 and supplies it to the preheating furnace 7. The temperature of the exhaust gas at the exit of the heating furnace 8 is 800° to 1200° C. which is higher than that of the spontaneous flaming of non-combustion, and the part of non-combustion can be easily burnt by only supplying the air in the after-burning chamber 54, whereby said part of noncombustion in the exhaust gas is not released into the air, and the temperature of the exhaust gas is heightened to accelerate the preheating of the steel band. The burning chamber 54 is divided at its exit into two routes to the side of the preheating furnace 7 and the exhaust side, and a suitable amount of the exhaust gas is led to the preheating furnace.

When the atmosphere gas of the 3rd chamber **49*c* and the atmosphere gas of the indirectly heating furnace 9 flow into the reduction heating range of the heating furnace 8, the reducing ability is lowered. The temperatures of these atmosphere gases are near the soaking temperatures of the steel band (700° to 900° C.) but lower than the temperature of the combustion gas (1400° to 1600° C.), and if the atmosphere gas goes into the reduction furnace, the gas temperature of the reduction heating range is lowered. Therefore, a 2nd after-burning chamber 57 is provided, and the atmosphere gases of the 3rd chamber 49*c* and the indirect heat furnace 9 are led to the 2nd after-burning chamber 57** to solve such problem.

Figure 1:
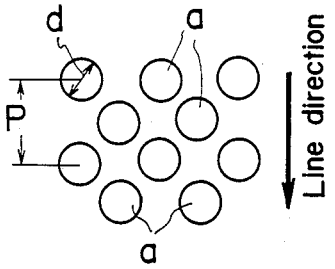
FIGS. 1 and 2 are explanatory views showing arrangements of the heating burners in this invention.
Figure 2:
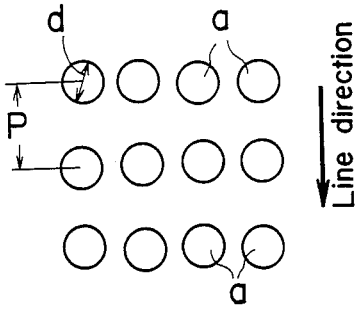
Figure 3:
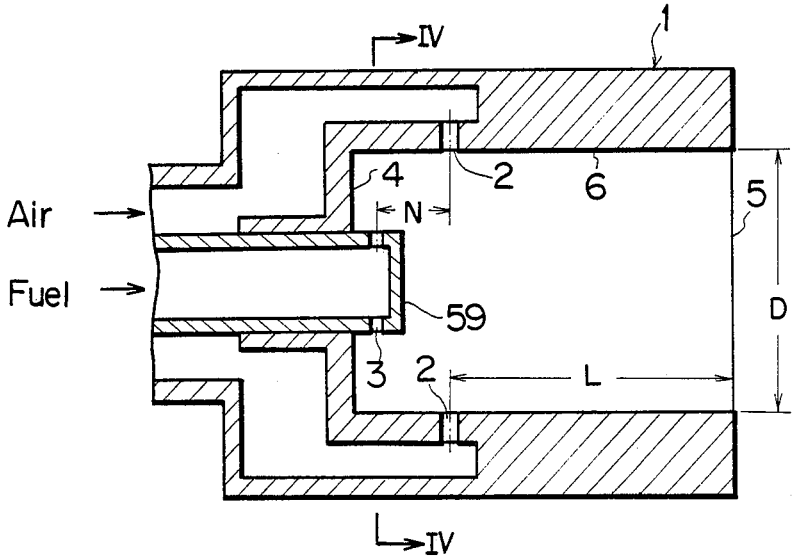
FIGS. 3 and 4 are one example of the heating burner to be used in the direct flame heating furnace in the continuously treating line of the invention.
Figure 4:
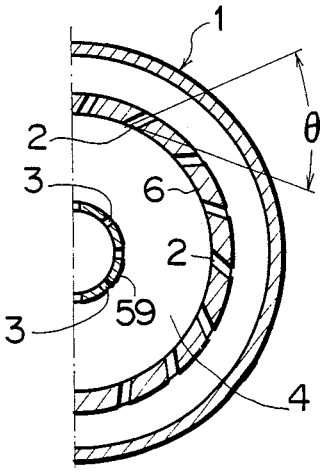
Figure 5:
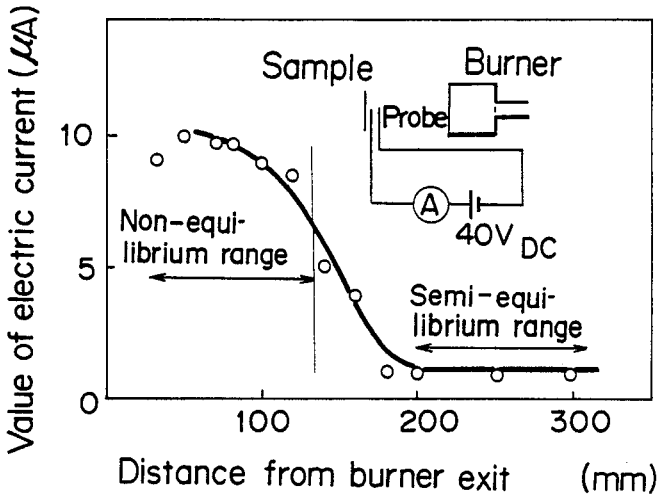
FIG. 5 is a graph showing one example of measuring non-equilibrium range forming scope within the heating burner of FIGS. 3 and 4.
Figure 6:
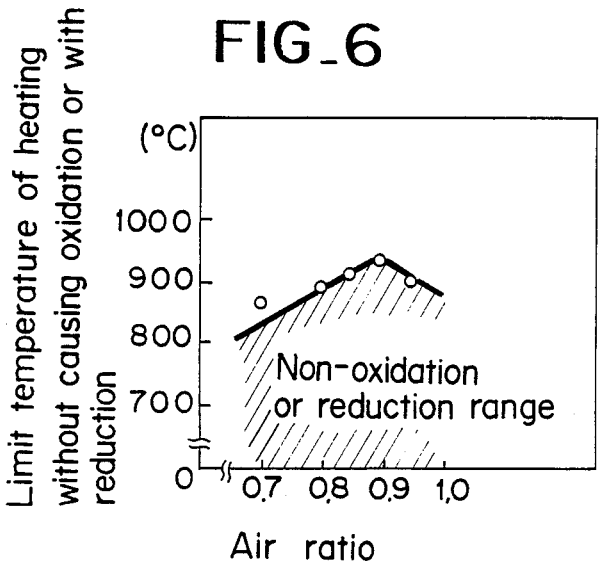
FIG. 6 is a graph showing reduction heating characteristics of the heating burner.

Referring back to FIGS. 3 and 4, the structure of the heating burner shown therein will be explained.

The reference numeral 59 designates the fuel gas nozzle projected from the inner wall 4 of the burner tile, and in the present embodiment, the fuel gas jetting outlets 3 are formed with spaces circumferentially of the fuel gas nozzle 59.

In this burner, the air outlet 2 is defined with an air supply angle O, because the combustion air is effected with a swirling flow within the burner tile, and by this swirling flow a negative pressure is formed at the inner side of the burner, and by this negative pressure the gas is recirculated and the combustion is accelerated, whereby a stable non-equilibrium range of the air and the fuel is formed.

The air supply ange O is 60° at the maximum, preferably 20° to 40°, for providing stable swirling of the air flow.

When a distance N in the burner axial direction between the air outlet 2 and the fuel gas outlet 3 is (−) side, the gas temperature is high and the product in the intermediate combustion is spread widely, but on the other hand, free $O_2$ (non-reacted $O_2$) is spread in the axial length. For exactly forming non-equilibrium range, it is necessary to minimize a free $O_2$ existing distance in the axial direction of the burner, and a limit therefor is −0.1 D.

Figure 25:
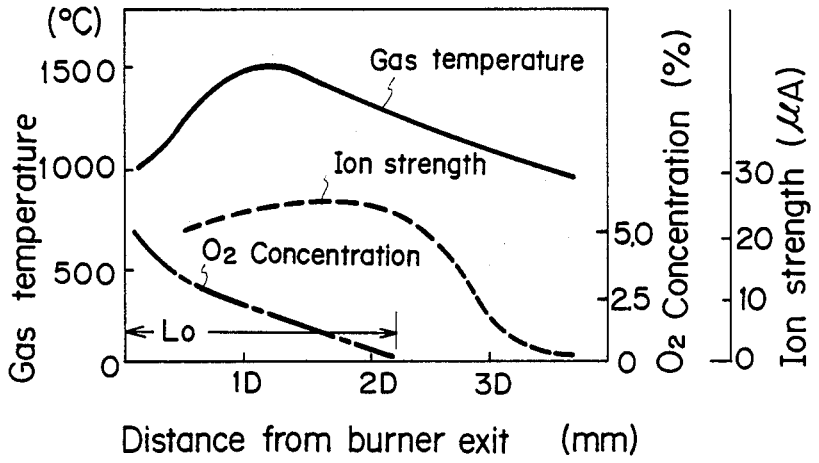

FIG. 25 investigates relationship, when said distance N is −0.25 D, between the distance in the burner axial direction from the burner exit, the gas temperature in the burner tile, $O_2$ concentration and ion strength. It is seen that when N is at (−) side, a remaining distance $L_0$ of the free $O_2$ existing in the axial direction is large.

Figure 26:
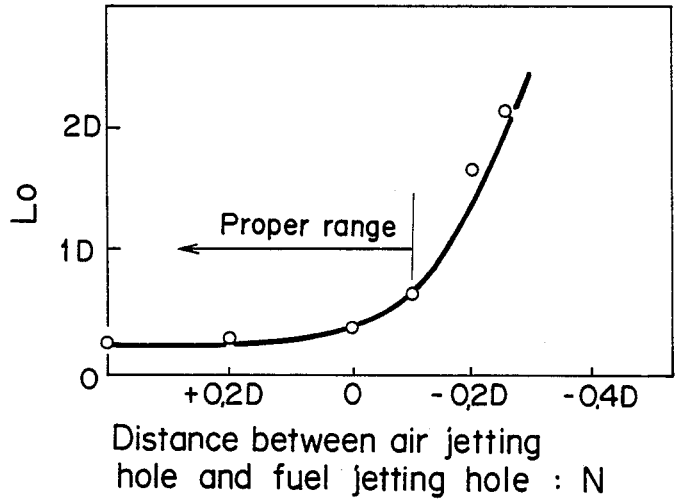

FIG. 26 shows relationship between said distance N and said free $O_2$ existing distance. It is seen that when N is larger in (−) side than −0.1 D, $L_0$ becomes rapidly large. Therefore, a limit in (−) side is −0.1 D.

Figure 27:
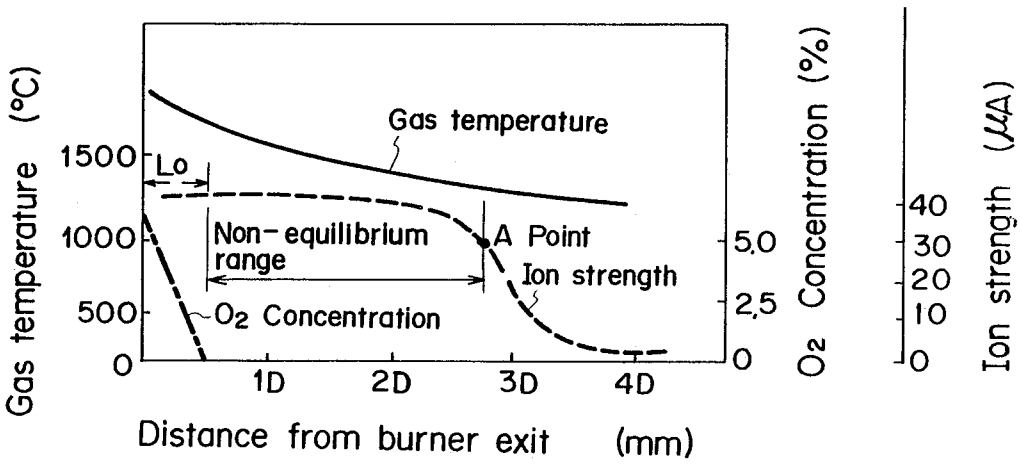

FIG. 27 shows relationship, when N is +0.1 D, between the distance in the burner axial direction from the burner exit, $O_2$ concentration, ion strength and gas temperature.

In FIGS. 26 and 27, when N is at (+) side, no problem is involved with $O_2$ concentration, and a suitable non-equilibrium range is formed at a spot where the distance from the burnre exit is more than 0.5 D.

When N is at (+) side, the suitable non-equilibrium range is formed, but if exceeding +0.4 D, the air and the fuel are not fully mixed. In this regard, in the invention, the mixture of the air and the fuel gas is accelerated by jetting the fuel gas from the center of the nozzle during rapid rotation of the air, but if N is made exceedingly large, said acceleration is not fully obtained, and a stable non-equilibrium range could not be expected. So, N is +0.4 D at the maximum. Thus, the distance N is −0.1 D to 0.4 D.

Figure 28:
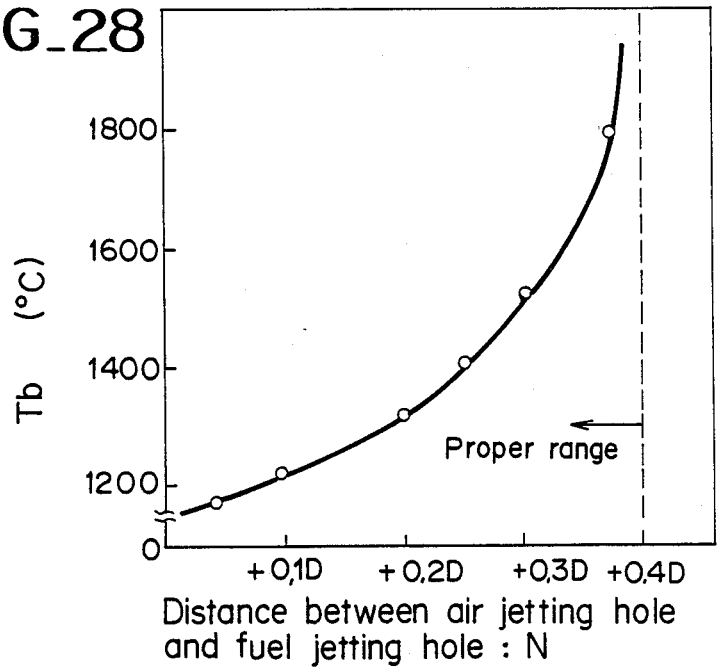

When N becomes larger, the temperature of the inner end wall of the burner tile is heightened. FIG. 28 shows the relationship between the distance N and the temperature Tb of the inner end wall of the burner tile. When N is +0.25 D, Tb is 1400° C., and in general, up to this temperature, the ordinary heat resisting material may be used. When N is +0.4 D, the inner end wall of the burner tile is heightened more than 1800° C., and then a high heat resistant material should be used for the burner tile.

The distance L from the air outlet 2 to the exit 5 of the burner tile has a close relation with a scope of forming the non-equilibrium range. If L exceeds 3 D, the non-equilibrium range is formed only at a part just after the exit of the burner tile. If L is less than 0.6 D, the flame is shaped like a flower petal, and non-equilibrium range is not exactly formed centrally of the burner. Therefore, it is preferable to determine L in the scope of 0.6 to 3.0 D.

Figure 29:
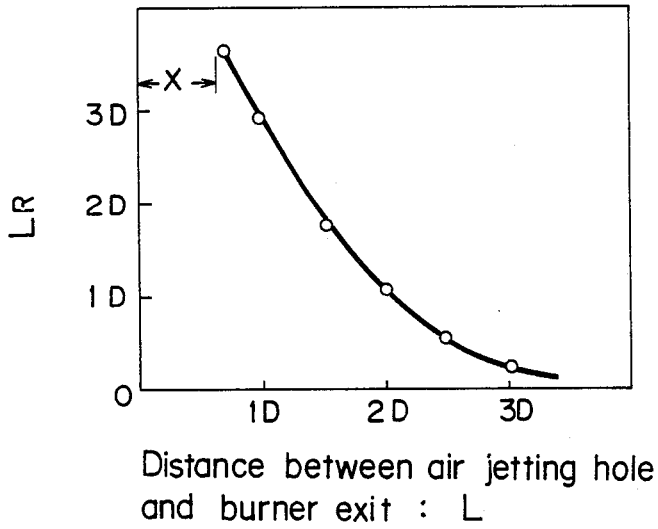

When a thin steel sheet is subjected to a continuous heating, a distance between the burner tile exit 5 and the steel sheet should be more than 100 mm, otherwise the steel sheet contacts the burner. Therefore, it is preferable to form non-equilibrium range in the flame in a scope as wide as possible, including the steel band passing place at a determined distance from the burner exit. FIG. 29 shows the relation betwen the distance L and a distance $L_R$ from the burner exit to a termination of non-equilibrium range (end opposite to burner, e.g., "A" point of FIG. 27). If L exceeds 3 D, the non-equilibrium range is formed only just after the exit of the burner tile. As L becomes smaller, non-equilibrium range is enlarged, but if L is at a range (X) of less than 0.6 D, the flame is formed like a flower petal just after the burner tile, and the required range is not formed centrally of the burner. Thus, the distance L from the air outlet 2 to the exit 5 of the burner tile is 0.6 D to 3.0 D.

In the above mentioned structure of the burners, if the swirling flow of the air from the combustion air outlet 2 is too strong, the dispersion of the temperature is not uniform in a diameter direction of the burner, and as a result, it is often difficult to form the non-equilibrium range. In such a case, in order to moderate the air swirling and uniformly disperse the temperature the invention may adopt solely or in combination following strutures, that is, a structure, where a jetting direction of the fuel gas outlet 3 is not perpendicular with respoect to a tangent line of the outer circumference of the fuel nozzle, and the fuel gas flow is made a swirl flow contrary to the air flow from the air outlet 2, that is, the fuel gas flow collides to the air swirling flow in a contrary direction, or a structure, where the fuel gas outlet 3 has a jetting direction made oblique with respect to the burner axial line, or a structure, where an air outlet 2 is given an oblique angle (twist angle) toward the burner opening with respect to the diameter direction of the burner tile.

The following structures will be also adopted, a structure, where in order to enlarge the heating area by the burner, the diameter of the burner is expanded at an inner wall of the opening end than the air outlet, or a structure, where in order to make easy forming of the air outlet 2, a swirling flow passage of the combustion air is formed, following the circumferential direction of the burner in the tubular burner tile, and a plurality of the combustion air outlets are formed to make said swirling flow passage communicate with the inner side of the burner.

INDUSTRIAL APPLICABILITY

The present invention may be applied to the continulusly annealing line, the hot dip-Zn plating line and others.

What is claimed is:

1. A continuously treating line for a steel band having a heating furnace by directly flaming, wherein said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

2. A continuously treating line as claimed in claim 1, wherein said burners are arranged with said spaces all over available heating scope of said heating furnace.

3. A continuously treating line as claimed in claim 1 wherein with respect to the available length of the heating furnace, said burners are arranged with said spaces in the length of an exit of more than $\gamma\%$ which is obtained by an under equation, and burners of non-reduction type are arranged in in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

4. A continuously treating line as claimed in claim 1, wherein said burners are arranged with said spaces at exits including the heating ranges before passing rolls at exits PASSEes of said heating furnace.

5. A continuously treating line for a steel band having a heating furnace by directly flaming and an indirectly heating furnace, wherein said directly heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

6. A continuously treating line as claimed in claim 5, wherein said burners are arranged with said spaces all over available heating scope of said heating furnace.

7. A continuously treating line as claimed in claim 5, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) [$=127000\ e^{-(6433/T)}$]

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

8. A continuously treating line as claimed in claim 5, wherein said burners are arranged with said spaces at exits including the heating ranges before passing rolls at exits PASSEes of said heating furnace.

9. A continuously treating line for a steel band having, in order, an oxidizing furnace by directly flaming, a reducing furnace by directly flaming, an indirectly heating furnace and a hot-dip zinc plating apparatus, wherein said reducing furnace is provided with a plurality of heating burners of reduction type which, in a flame, form non-equilibrium range of the air and a fuel with products in an intermediate combustion and without free oxygen, and said reducing furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

10. A continuously treating line as claimed in claim 9, wherein said burners are arranged with said spaces all over available heating scope of said reducing furnace.

11. A continuously treating line as claimed in claim 9, wherein with respect to the available length of the reducing furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) [$=127000\ e^{-(6433/T)}$]

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

12. A continuously treating line as claimed in claim 9, wherein said burners are arranged with said spaces at exits including the heating ranges before passing rolls at exits PASSEes of said heating furnace.

13. A continuously treating line for a steel band having a oxidizing furnace by directly flaming, a reducing furnace by directly flaming and a hot-dip zinc plating apparatus, wherein said reducing furnace is provided with a plurality of heating burners of reduction type which, in a flame, form non-equilibrium range of the air and a fuel with products in an intermediate combustion and without free oxygen, and said reducing furnace is arranged with said burners such that the flame collides against the steel band on its surface perpendicularly within said nonequilibrium range, and said arrangement of the burners is made with spaces where (inner diameter of burner)/(pitch of burner) in a line direction is more than 0.3.

14. A continuously treating line as claimed in claim 13, wherein said burners are arranged with said spaces all over available heating scope of said reducing furnace.

15. A continuously treating line as claimed in claim 13, wherein with respect to the available length of the reducing furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) [$=127000\ e^{-(6433/T)}$]

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

16. A continuously treating line as claimed in claim 13, wherein said burners are arranged with said spaces at exits including the heating ranges before passing rolls at exits PASSEes of said heating furnace.

17. A continuously treating line for a steel band having a heating furnace by directly flaming and an atmosphere furnace, wherein said atmosphere furnace is provided with a seal chamber at an upper part of sealing rolls at an exit, and provided with a means for detecting pressure in said atmosphere furnace and a means for blowing the sealing gas into the sealing chamber when the furnace pressure is decreased, and said heating furnace is provided with a plurality of heating burners of reduction type which may, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

18. A continuously treating line as claimed in claim 17, wherein said burners are arranged with said spaces all over available heating scope of said heating furnace.

19. A continuously treating line as claimed in claim 17, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) [$=127000\ e^{-(6433/T)}$]

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

20. A continuously treating line as claimed in claim 17, wherein said burners are arranged with said spaces at exits including the heating ranges before passing rolls at exits PASSEes of said heating furnace.

21. A continuously treating line for a steel band having, in order, a pre-heating furnace, a heating furnace by directly flaming and an indirectly heating furnace, wherein an intermediate chamber is provided between said furnaces for preventing the furnace gas from moving into other furnace and said directly heating furnace is provided with a plurality of heating burners of reduction type which, in a flame, form non-equilibrium range of the air and a fuel with products in an intermediate combustion and without free oxygen, and said directly heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

22. A continuously treating line as claimed in claim 21, wherein said burners are arranged with said spaces all over available heating scope of said directly heating furnace.

23. A continuously treating line as claimed in claim 21, wherein with respect to the available length of the directly heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) [$=127000\ e^{-(6433/T)}$]

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

24. A continuously treating line as claimed in claim 21, wherein said burners are arranged with said spaces at exits including the heating ranges before passing rolls at exits PASSEes of said heating furnace.

25. A continuously treating line for a steel band having, in order, a pre-heating furnace, a heating furnace by directly flaming and indirectly heating furnace, wherein an intermediate chamber is provided between said furnaces for preventing the furnace gas from moving into another furnace, and an after-burning chamber is provided between said heating furnace and the preheating furnace for perfectly burning the combustion exhaust gas within said heating furnace and supplying it into the pre-heating furnace, and said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

26. A continuously treating line as claimed in claim 25, wherein said burners are arranged with said spaces all over available heating scope of said heating furnace.

27. A continuously treating line as claimed in claim 25, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 $[=69200\ e^{-(6126/T)}]$ F(T): Heating rate (°K/sec) [=dT/dt]

28. A continuously treating line as claimed in claim 25, wherein said burners are arranged with said spaces at exits including the heating ranges before passing rolls at exits PASSEes of said heating furnace.

29. A continuously treating line for a steel band having, in order, a heating furnace by directly flaming, an indirectly heating furnace, and a cooling furnace where cooling is main for rolls, and provided with a temper rolling machine at an exit of a finally treated steel band, wherein said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

30. A continuously treating line as claimed in claim 29, wherein said burners are arranged with said spaces all over available heating scope of said heating furnace.

31. A continuously treating line as claimed in claim 29, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 $[=69200\ e^{-(6126/T)}]$ F(T): Heating rate (°K/sec) [=dT/dt]

32. A continuously treating line as claimed in claim 29, wherein said burners are arranged with said spaces at exits including the heating ranges before passing rolls at exits PASSEes of said heating furnace.

33. A continuously treating line for a steel band having, in order, a pre-heating furnace, a heating furnace by directly flaming, an indirectly heating furnace, and a cooling furnace where cooling is main for rolls, and provided with a temper rolling machine at an exit of a finally treated steel band, wherein said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

34. A continuously treating line as claimed in claim 33, wherein said burners are arranged with said spaces all over available heating scope of said heating furnace.

35. A continuously treating line as claimed in claim 33, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

36. A continuously treating line as claimed in claim 33, wherein said burners are arranged with said spaces at exits including the heating ranges before passing rolls at exits PASSEes of said heating furnace.

37. A continuously treating line for a steel band having, in order, a cleaning facility for the surface of a steel band, a pre-heating furnace, a heating furnace by directly flaming, an indirectly heating furnace and a cooling furnace where cooling is main for rolls, and provided with a temper rolling machine at an exit of a finally treated steel band, wherein said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

38. A continuously treating line as claimed in claim 37, wherein said burners are arranged with said spaces all over available heating scope of said heating furnace.

39. A continuously treating line as claimed in claim 37, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) [$=127000\ e^{-(6433/T)}$]

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

40. A continuously treating line as claimed in claim 37, wherein said burners are arranged with said spaces at exits including the heating ranges before passing rolls at exits PASSEes of said heating furnace.

41. A continuously treating line for a steel band having, in order, a heating furnace by directly flaming, an indirectly heating furnace, a cooling furnace where cooling is main for liquid an intermediate pickling facility and an overaging furnace, and provided with a temper rolling machine at an exit of a finally treated steel band, wherein said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

42. A continuously treating line as claimed in claim 41, wherein said burners are arranged with said spaces all over available heating scope of said heating furnace.

43. A continuously treating line as claimed in claim 41, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T)\cdot\frac{dT}{F(T)} - \int_{T_{IN}}^{T^*} B(T)\cdot\frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) [$=127000\ e^{-(6433/T)}$]

T*: Temperature (°K) of the steel band at boundary between position of the reducing burner and position of the non-reducing burner B(T): Oxidizing rate of the steel band (A/sec) and position of the reducing burner 1 [$=69200\ e^{-(6126/T)}$]

F(T): Heating rate (°K/sec) [=dT/dt]

44. A continuously treating line as claimed in claim 41, wherein said burners are arranged with said spaces at exits including the heating ranges before passing rolls at exits PASSEes of said heating furnace.

45. A continuously treating line for a steel band having, in order, having a pre-heating furnace, a heating furnace by directly flaming, an indirectly heating furnace, a cooling furnace where cooling is main for liquid, an intermediate pickling facility and overaging furnace, and provided with a temper rolling machine at an exit of a finally treated steel band, wherein said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

46. A continuously treating line as claimed in claim 45, wherein said burners are arranged with said spaces all over available heating scope of said heating furnace.

47. A continuously treating line as claimed in claim 45, wherein with respect to the available length of the heating furnace, said burners are arranged with said spaces in the length of an exit of more than $\gamma\%$ which is obtained by an under equation, and burners of non-reduction type are arranged in a remaining available length, $$\int_{T^*}^{T_{OUT}} A(T) \cdot \frac{dT}{F(T)} - \int_{T_{IN}}^{T^*} B(T) \cdot \frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 $[=69200\ e^{-(6126/T)}]$ F(T): Heating rate (°K/sec) [=dT/dt]

48. A continuously treating line as claimed in claim 45, wherein said burners are arranged with said spaces at exits including the heating ranges before passing rolls at exits PASSEes of said heating furnace.

49. A continuously treating line for a steel band having, in order, a cleaning facility for the surface of a steel band, a pre-heating furnace, a heating furnace by directly flaming, an indirectly heating furnace, a cooling furnace where cooling is main for liquid, an intermediate pickling facility and an overaging furnace, and provided with a temper rolling machine at an exit of a finally treated steel band, wherein said heating furnace is provided with a plurality of heating burners of reduction type which, in a flame, form non-equilibrium range of the air and a fuel with products in an intermediate combustion and without free oxygen, and said heating furnace is arranged with said burners such that the flame collides against the steel band on its surface perpendicularly within said non-equilibrium range, and said arrangement of the burners is made with spaces where (inner diameter of burner)/(pitch of burner) in a line direction is more than 0.3.

50. A continuously treating line as claimed in claim 49, wherein said burners are arranged with said spaces all over available heating scope of said heating furnace.

51. A continuously treating line as claimed in claim 49, wherein with respect to the available length of the heating furnace, said burners are arranged with said spaces in the length of an exit of more than $\gamma$% which is obtained by an under equation, and burners of non-reduction type are arranged in a remaining available length, $$\int_{T^*}^{T_{OUT}} A(T) \cdot \frac{dT}{F(T)} - \int_{T_{IN}}^{T^*} B(T) \cdot \frac{dT}{F(T)} = 0$$

$$\gamma = [(T_{OUT} - T^*)/(T_{OUT} - T_{IN})] \times 100$$

Herein, $T_{IN}$: Temperature of the steel band at an entrance of the direct flame heating furnace (°K)

$T_{OUT}$: Temperature of the steel band at an exit of the direct flame heating furnace (°K)

A(T): Reducing rate of the steel band (A/sec) $[=127000\ e^{-(6433/T)}]$

T*: Temperature (°K) of the steel band at boundary between position of the reducing burner and position of the non-reducing burner B(T): Oxidizing rate of the steel band (A/sec) and position of the reducing burner 1 $[=69200\ e^{-(6126/T)}]$ F(T): Heating rate (°K/sec) [=dT/dt]

52. A continuously treating line as claimed in claim 49, wherein said burners are arranged with said spaces at exits including the heating ranges before passing rolls at exits PASSEes of said heating furnace.

* * * * *

UNITED STATES PATENT OFFICE

CERTIFICATE OF CORRECTION

Patent No. 4,760,995 Dated Aug. 2, 1988

Inventor(s) Shuzo Fukuda; Masahiro Abe; Shiro Fukunaka; Michio Nakayama; Shuji Kaneto; Masayuki Yamazaki; Kouichio Arima It is certified that error appears in the above-identified patent and that said Letters Patent is hereby corrected as shown below:

Column 10, line 20, after "2000 Kcal/$Nm^3$" insert

--- and more--

Signed and Sealed this

Fifteenth Day of August, 1989

*Attest:*

*Attesting Officer*

DONALD J. QUIGG

*Commissioner of Patents and Trademarks*